US005896612A

United States Patent [19]

Maruyama et al.

[11] Patent Number: 5,896,612

[45] **Date of Patent: *Apr. 27, 1999**

[54] METHOD AND APPARATUS FOR REMOVING IMAGE FORMING SUBSTANCE FROM IMAGE HOLDING MEMBER

[75] Inventors: Tohru Maruyama, Fujisawa; Masatoshi Saito, Machida; Taro Terashi; Hisao Watanabe, both of Sagamihara; Shigeru Fujita, Machida; Masaru Shinkai, Yokohama; Tomoaki Sugawara, Warab, all of Japan

[73] Assignee: Ricoh Company, Ltd., Tokyo, Japan

[ * ] Notice: This patent is subject to a terminal disclaimer.

[21] Appl. No.: 08/816,498

[22] Filed: Mar. 13, 1997

Related U.S. Application Data

[62] Division of application No. 08/385,159, Feb. 7, 1995, Pat. No. 5,642,550.

[30] Foreign Application Priority Data

| | | | |
|---|---|---|---|
| Feb. 28, 1994 | [JP] | Japan | 6-055091 |
| Feb. 28, 1994 | [JP] | Japan | 6-055094 |
| Nov. 14, 1994 | [JP] | Japan | 6-305649 |

[51] Int. Cl.[6] ..... B08B 1/02; G03G 21/00

[52] U.S. Cl. ..... 15/102

[58] Field of Search ..... 015/1.51, 102, 015/3, 97.1, 100, 103.5; 399/123, 154, 162, 296, 297, 303, 343, 346, 353; 156/230, 247, 241, 281, 584, 389; 134/48, 64 R, 64 P, 122 R, 122 P

[56] References Cited

U.S. PATENT DOCUMENTS

| | | |
|---|---|---|
| 207,626 | 9/1878 | Sargent . |
| 722,252 | 3/1903 | Richards . |
| 1,947,748 | 2/1934 | Van Wormer . |
| 2,207,966 | 7/1940 | Billings, Jr. . |
| 2,831,409 | 4/1958 | Bixby et al. . |
| 2,937,390 | 5/1960 | Bolton et al. . |

(List continued on next page.)

FOREIGN PATENT DOCUMENTS

| | | |
|---|---|---|
| 50-56942 | 5/1975 | Japan . |
| 51-100728 | 9/1976 | Japan . |
| 54-27435 | 3/1979 | Japan . |

(List continued on next page.)

OTHER PUBLICATIONS

Kirk–Othmer Encyclopedia of Chemical Technology, Third Edition, vol. 6, 1979, pp. 386–426, Stanley C. Zink, "Coating Processes".

*Primary Examiner*—Tony G. Soohoo

*Attorney, Agent, or Firm*—Oblon, Spivak, McClelland, Maier & Neustadt, P.C.

[57] ABSTRACT

In a method and an apparatus for removing an image forming substance such as toner from an image holding member such as a transfer paper sheet, the toner on the transfer paper sheet is heated to be melted or softened. An offset belt having adhesive force stronger than that between the transfer paper sheet and the toner comes in contact with the toner. The toner is separated and removed from the transfer paper sheet when the offset belt and the transfer paper sheet are separated from each other. Heating of the toner is maintained until the transfer paper sheet is separated from the offset belt. The transfer paper sheet is separated from the offset belt before the toner is cooled and solidified. A toner heating maintaining device is constructed by using a heating-supporting member having a heater therein and arranged such that the transfer paper sheet and the offset belt are supported between the heating-supporting member and a heating roller. The heating-supporting member has a bent portion on a downstream side in a conveying direction of the transfer paper sheet.

87 Claims, 10 Drawing Sheets

U.S. PATENT DOCUMENTS

| | | | |
|---|---|---|---|
| 3,108,895 | 10/1963 | Howell . | |
| 3,202,532 | 8/1965 | Labombarde . | |
| 3,237,231 | 3/1966 | Zink . | |
| 3,328,821 | 7/1967 | La Mura . | |
| 3,448,720 | 6/1969 | Graham . | |
| 3,598,487 | 8/1971 | Mizuguchi et al. . | |
| 3,613,701 | 10/1971 | Ando . | |
| 3,630,776 | 12/1971 | Barr | 134/9 |
| 3,656,948 | 4/1972 | Mammino . | |
| 3,776,631 | 12/1973 | Mammino . | |
| 4,249,653 | 2/1981 | Kufferath-Kassner . | |
| 4,252,882 | 2/1981 | Herrmann . | |
| 4,388,391 | 6/1983 | Schell . | |
| 4,392,742 | 7/1983 | Landa . | |
| 4,482,241 | 11/1984 | Moraw et al. . | |
| 4,504,995 | 3/1985 | Zippwald, Sr. . | |
| 4,733,422 | 3/1988 | Schramm et al. . | |
| 4,740,075 | 4/1988 | Schoernig . | |
| 4,800,839 | 1/1989 | Ariyama et al. | 399/57 |
| 4,899,872 | 2/1990 | Hokao . | |
| 4,905,047 | 2/1990 | Ariyama | 399/102 |
| 4,965,640 | 10/1990 | Watarai et al. . | |
| 5,063,411 | 11/1991 | Haneda et al. . | |
| 5,215,852 | 6/1993 | Kato et al. | 430/126 |
| 5,262,259 | 11/1993 | Chou et al. | 430/47 |
| 5,353,108 | 10/1994 | Tsukamoto | 355/296 |
| 5,359,398 | 10/1994 | Echigo et al. . | |
| 5,474,617 | 12/1995 | Saito et al. | 15/102 |

FOREIGN PATENT DOCUMENTS

| | | |
|---|---|---|
| 54-99353 | 8/1979 | Japan . |
| 55-30500 | 3/1980 | Japan . |
| 55-154198 | 12/1980 | Japan . |
| 55-15498 | 12/1980 | Japan . |
| 57-114171 | 7/1982 | Japan . |
| 57-125962 | 8/1982 | Japan . |
| 57-125963 | 8/1982 | Japan . |
| 57-190675 | 11/1982 | Japan . |
| 58-105569 | 7/1983 | Japan . |
| 59-2069 | 1/1984 | Japan . |
| 59-33483 | 5/1984 | Japan . |
| 59-89372 | 5/1984 | Japan . |
| 59-93764 | 5/1984 | Japan . |
| 59-98172 | 6/1984 | Japan . |
| 60-133458 | 7/1985 | Japan . |
| 60-182465 | 9/1985 | Japan . |
| 60-193691 | 10/1985 | Japan . |
| 60-230899 | 11/1985 | Japan . |
| 61-213185 | 9/1986 | Japan . |
| 61-237684 | 10/1986 | Japan . |
| 62-14163 | 1/1987 | Japan . |
| 62-102270 | 5/1987 | Japan . |
| 62-203190 | 9/1987 | Japan . |
| 62-212187 | 9/1987 | Japan . |
| 62-199767 | 12/1987 | Japan . |
| 63-39377 | 2/1988 | Japan . |
| 63-73282 | 4/1988 | Japan . |
| 63-140577 | 9/1988 | Japan . |
| 1-101576 | 4/1989 | Japan . |
| 1-101577 | 4/1989 | Japan . |
| 1-137266 | 5/1989 | Japan . |
| 1-145680 | 6/1989 | Japan . |
| 1-297294 | 11/1989 | Japan . |
| 2-11400 | 1/1990 | Japan . |
| 2-3400 | 1/1990 | Japan . |
| 2-3876 | 1/1990 | Japan . |
| 2-19568 | 2/1990 | Japan . |
| 2-55195 | 2/1990 | Japan . |
| 2-59926 | 2/1990 | Japan . |
| 2-62277 | 3/1990 | Japan . |
| 2-111987 | 4/1990 | Japan . |
| 2-188293 | 4/1990 | Japan . |
| 2-188294 | 7/1990 | Japan . |
| 2-117547 | 9/1990 | Japan . |
| 2-227299 | 9/1990 | Japan . |
| 3-116594 | 5/1991 | Japan . |
| 3-68460 | 7/1991 | Japan . |
| 3-218898 | 9/1991 | Japan . |
| 3-249661 | 11/1991 | Japan . |
| 4-22968 | 1/1992 | Japan . |
| 4-57070 | 2/1992 | Japan . |
| 4-64472 | 2/1992 | Japan . |
| 4-64473 | 2/1992 | Japan . |
| 4-67043 | 3/1992 | Japan . |
| 4-82983 | 3/1992 | Japan . |
| 4-89271 | 3/1992 | Japan . |
| 4-91298 | 3/1992 | Japan . |
| 4-126900 | 4/1992 | Japan . |
| 4-234056 | 8/1992 | Japan . |
| 4-118499 | 10/1992 | Japan . |
| 4-118500 | 10/1992 | Japan . |
| 4-281096 | 10/1992 | Japan . |
| 4-300395 | 10/1992 | Japan . |
| 4-301664 | 10/1992 | Japan . |
| 4-327299 | 11/1992 | Japan . |
| 4-333088 | 11/1992 | Japan . |
| 4-333699 | 11/1992 | Japan . |
| 4-356085 | 12/1992 | Japan . |
| 4-356086 | 12/1992 | Japan . |
| 4-356087 | 12/1992 | Japan . |
| 4-356088 | 12/1992 | Japan . |
| 4-356089 | 12/1992 | Japan . |
| 4-362935 | 12/1992 | Japan . |
| 5-2356 | 1/1993 | Japan . |
| 5-32926 | 2/1993 | Japan . |
| 5-61382 | 3/1993 | Japan . |
| 5-127571 | 5/1993 | Japan . |
| 5-148435 | 6/1993 | Japan . |
| 5-173454 | 7/1993 | Japan . |
| 5-197315 | 8/1993 | Japan . |
| 5-216374 | 8/1993 | Japan . |
| 5-216375 | 8/1993 | Japan . |
| 5-216376 | 8/1993 | Japan . |
| 5-221128 | 8/1993 | Japan . |
| 5-232737 | 9/1993 | Japan . |
| 5-232738 | 9/1993 | Japan . |
| 5-246115 | 9/1993 | Japan . |
| 5-297766 | 11/1993 | Japan . |
| 5-323831 | 12/1993 | Japan . |
| 5-323832 | 12/1993 | Japan . |
| 6-11938 | 1/1994 | Japan . |
| 6-19181 | 1/1994 | Japan . |
| 6-8623 | 1/1994 | Japan . |
| 6-8626 | 1/1994 | Japan . |
| 6-13651 | 2/1994 | Japan . |
| 6-13652 | 2/1994 | Japan . |
| 6-27710 | 2/1994 | Japan . |
| 6-27735 | 2/1994 | Japan . |
| 6-27736 | 2/1994 | Japan . |
| 6-27737 | 2/1994 | Japan . |
| 6-27738 | 2/1994 | Japan . |
| 6-27739 | 2/1994 | Japan . |
| 6-43682 | 2/1994 | Japan . |
| 6-67576 | 3/1994 | Japan . |
| 6-206358 | 7/1994 | Japan . |
| 6-208318 | 7/1994 | Japan . |
| WO 89/03728 | 5/1989 | WIPO . |

METHOD AND APPARATUS FOR REMOVING IMAGE FORMING SUBSTANCE FROM IMAGE HOLDING MEMBER

This is a Division of application Ser. No. 08/385,159 filed on Feb. 7, 1995, now U.S. Pat. No. 5,642,550.

BACKGROUND OF THE INVENTION

1. Field of the Invention

The present invention relates to a method and an apparatus for removing an image forming substance from the surface of an image holding member on which an image constructed by the image forming substance is formed by an image forming apparatus such as a copying machine, a facsimile telegraph, a printer, etc. More particularly, the present invention relates to a method and an apparatus for removing an image forming substance from an image holding member in which the image forming substance on the image holding member is heated to be melted or softened, and a separating member having adhesive force stronger than that between the image holding member and the image forming substance comes in contact with the image forming substance, and the image forming substance is separated and removed from the image holding member when the separating member and the image holding member are separated from each other.

2. Description of the Related Art

There are generally various kinds of known methods and apparatuses for removing an image forming substance such as toner from a recorded image holding member such as a sheet of paper. For example, Japanese Patent Application Laying Open (KOKAI) No. 1-101576 shows an image forming substance removing method using a solvent. In this image forming substance removing method, a sheet of paper attaching toner thereto is dipped into a soluble solvent of toner resin and a supersonic wave is vibrated to separate the toner dissolved into the solvent from a paper face. Further, Japanese Patent Application Laying Open (KOKAI) No. 4-300395 shows another image forming substance removing method in which a solvent is attached to a printed portion of used paper by an attaching method using dipping, spraying or coating, etc., to dissolve toner so that the dissolved toner is removed from the printed portion by a removing method such as cleaning, air suction, adsorbent contact, mechanical separation, electrostatic adsorption, etc.

For example, Japanese Patent Application Laying Open (KOKAI) No. 2-55195 shows another image forming substance removing method in which no solvent is used. In this image forming substance removing method, thermally melted ink or toner is attached by an electrophotographic system or a thermal transfer system onto a printed member in which a supporting member is coated with a mold-releasing agent. An ink separating member is overlapped with the printed member and is moved between a heating roller and a pressure roller. After the ink separating member is cooled, the ink is attached to the ink separating member by separating the ink separating member from the printed member so that the ink is removed from the printed member. Further, Japanese Patent Application Laying Open (KOKAI) No. 4-64472 shows an eraser having at least an endless sheet, heating and cooling rollers, a pressing roller and a driving section. The endless sheet has thermally melted resin on a surface thereof. The heating and cooling rollers support and rotate the endless sheet. The pressing roller presses a sheet of erasable paper having a mold-released surface against softened or thermally melted resin. The driving section operates these rollers in association with each other. Further, Japanese Patent Application Laying Open (KOKAI) No. 4-82983 shows an image forming substance removing apparatus having two parallel rollers, a heater, a scraper and a separator. The two parallel rollers are arranged in parallel with each other and come in press contact with each other and are rotated such that a sheet of paper passes through a press contact portion of these two parallel rollers. The heater heats at least one of the two parallel rollers. The scraper separates the paper sheet passing through the press contact portion from these two parallel rollers. The separator removes an image forming substance attached onto each of the two parallel rollers therefrom.

The above removing method and apparatus using no solvent can be used to remove the image forming substance from the recorded image holding member recording an image on a sheet of normal paper having exposed paper fibers on a surface thereof. In this case, for example, the image forming substance having thermally melted resin as a principal component is melted and attached onto the image holding member in a fixing process of the electrophotographic system. Accordingly, the image forming substance is strongly fixed onto paper fibers on the image holding member surface. Therefore, when the image forming substance is removed from the paper fibers, paper fibers on this image holding member surface are separated therefrom together with the image forming substance so that the paper sheet is damaged and a paper quality is reduced. In particular, when the above ink separating member, the endless sheet or each of the above rollers is heated or pressurized to improve a removing property of the image forming substance, fixing force between the image forming substance and the image holding member is reversely increased in various kinds of conditions so that it is difficult to remove the image forming substance from the image holding member.

Therefore, inventors of this patent application proposed another image forming substance removing method in Japanese Patent Application No. 4-255916. In this image forming substance removing method, at least one kind of water or aqueous solution is selected from a group of water as an unstabilizing agent, an aqueous solution including a surfactant, an aqueous solution including a water-soluble polymer, and an aqueous solution including a surfactant and a water-soluble polymer. This selected water or aqueous solution is held in a recorded image holding member. An image forming substance on the image holding member is heated to be melted or softened. A separating member having adhesive force stronger than that between the image holding member and the image forming substance then comes in contact with the image forming substance. When the separating member is separated from the image holding member, the image forming substance is separated and removed from the image holding member. In accordance with this image forming substance removing method, only the image forming substance can be removed from the image holding member without relatively reducing a paper quality of the image holding member.

FIG. 1 shows one constructional example of a toner separating unit of a toner removing apparatus capable of realizing this removing method. The toner separating unit separates toner as the image forming substance from a sheet of transfer paper 10 as the image holding member. This toner separating unit has a plurality of supporting rollers 41, 42, a belt 44 for a toner offset, upper and lower heating rollers 45, 46, a tension roller 49 and a rotating brush roller 50. The belt 44 for a toner offset is arranged as a separating member having a belt shape and wound around a separating roller 43. The upper and lower heating rollers 45 and 46 respectively have heating lamps 45*a* and 46*a* therein and are arranged such that these heating rollers 45 and 46 come in press contact with each other by a biasing means 45*b* such as a spring through the belt 44. The tension roller 49 is biased by a biasing means 49*a* such as a spring such that a belt portion between the supporting rollers 41 and 42 is pressed inside. The rotating brush roller 50 removes toner from a surface of the belt 44. At least a surface of this belt 44 is formed by a material having adhesive force stronger than that between a surface of the transfer paper sheet 10 and softened or melted toner. In this toner removing apparatus, after a belt portion passes through a pressurizing portion between the upper and lower heating rollers 45 and 46, a moving direction of the belt 44 is rapidly changed around the separating roller 43 winding this belt portion therearound. Thus, the transfer paper sheet 10 is separated from the belt 44 by using curvature. In this separation, the toner is separated and removed from the surface of the transfer paper sheet 10.

In the image forming substance removing apparatus for removing the image forming substance from the image holding member and proposed in the above Japanese Patent Application No. 4-255916, etc., there is a case in which the image holding member is cooled and solidified until the image holding member is separated from a surface of the separating member after the separating member comes in contact with the image forming substance softened or melted on the image holding member. For example, in the constructional example of the toner removing apparatus shown in FIG. 1, there is a case in which toner heated by the upper and lower heating rollers 45 and 46 and softened or melted on the transfer paper sheet 10 is cooled and solidified until a separating position of the transfer paper sheet 10 separated by the separating roller 43. When the image forming substance such as toner, etc. is cooled and solidified, no image forming substance can be reliably separated and removed from the image holding member even when the separating member is separated from the image holding member in this cooled and solidified state. This is because no adhesive force between the image forming substance and the image holding member is smaller than adhesive force between the image forming substance and the separating member surface in many cases. The image forming substance is also insufficiently separated from the image holding member when the above unstabilizing agent is not provided to the image holding member.

SUMMARY OF THE INVENTION

It is therefore an object of the present invention to provide a method and an apparatus for removing an image forming substance from an image holding member and capable of improving separating performance of the image forming substance from the image holding member using a separating member.

In accordance with a first construction of the present invention, the above object can be achieved by a method for removing an image forming substance from an image holding member in which the image forming substance on the image holding member is heated to be melted or softened;

a separating member having adhesive force stronger than that between the image holding member and the image forming substance comes in contact with the image forming substance; and the image forming substance is separated and removed from the image holding member when the separating member and the image holding member are separated from each other;

the removing method comprising the steps of:

maintaining heating of the image forming substance until the image holding member is separated from the separating member; and separating the image holding member from the separating member before the image forming substance is cooled and solidified.

In accordance with a second construction of the present invention, the above object can be also achieved by an apparatus for removing an image forming substance from an image holding member in which the image forming substance on the image holding member is heated to be melted or softened;

a separating member having adhesive force stronger than that between the image holding member and the image forming substance comes in contact with the image forming substance; and the image forming substance is separated and removed from the image holding member when the separating member and the image holding member are separated from each other;

the removing apparatus comprising:

heating-maintaining means for maintaining heating of the separating member until the image holding member is separated from the separating member.

In the above first or second construction of the present invention, at least one kind of water or aqueous solution may be provided to the image holding member before the image forming substance on the image holding member comes in contact with the separating member. This water or aqueous solution is selected from a group of water as an unstabilizing agent, an aqueous solution including a surfactant, an aqueous solution including a water-soluble polymer, and an aqueous solution including a surfactant and a water-soluble polymer.

In accordance with a third construction of the present invention, the above object can be also achieved by an apparatus for removing an image forming substance from an image holding member in which the image forming substance on the image holding member is heated to be melted or softened;

a separating member having a belt shape and adhesive force stronger than that between the image holding member and the image forming substance comes in contact with the image forming substance; and the image forming substance is separated and removed from the image holding member when the separating member and the image holding member are separated from each other;

the removing apparatus comprising:

separating member driving means for moving the separating member;

a heating-supporting member having heating means therein and sliding and supporting the moving separating member on a surface of the heating-supporting member;

a press contact member coming in press contact with the surface of the heating-supporting member such that the separating member on this surface and the image holding member coming in contact with the separating member are supported between this surface and the press contact member;

a curvature separating portion formed on a downstream side of the heating-supporting member in a moving direction of the separating member in a position in which no image forming substance is cooled and solidified;

the curvature separating portion guiding the moving direction of the separating member such that the image holding member is separated from a surface of the separating member by using curvature.

In accordance with a fourth construction of the present invention, the removing apparatus having the third construction further comprises:

a planar portion formed on the surface of the heating-supporting member coming in press contact with an elastic member roller used as the press contact member;

a length of the planar portion in the moving direction of the separating member being set to be equal to the length of a press contact portion between the elastic member roller and the heating-supporting member in this moving direction; and a tapered portion formed on the surface of the heating-supporting member such that the tapered portion is lowered from an end portion of the press contact portion on an upstream side in the moving direction of the separating member toward this upstream side; and the separating member is slid and moved in the planar portion and the tapered portion on the surface of the heating-supporting member.

In accordance with a fifth construction of the present invention, the heating-supporting member is constructed by a high thermal conductor and a holder for holding the heating-supporting member through an insulator is arranged in the third construction.

In accordance with a sixth construction of the present invention, the removing apparatus having the third construction further comprises temperature detecting means for detecting a temperature of the separating member surface just after the image holding member is separated from the separating member.

In the first or second construction of the present invention, heating of the image forming substance is maintained until the image holding member is separated from the separating member. The image holding member is separated from the separating member before the image forming substance is cooled and solidified. Accordingly, at a separating time, the image forming substance is maintained in a softened or melted state so that adhesive force of the image forming substance with respect to a surface of the separating member can be greatly reduced in comparison with adhesive force of the image forming substance with respect to the image holding member.

In the third construction of the present invention, the separating member having a belt shape and moved by the separating member driving means is slid on a surface of the heating-supporting member having the heating means therein. The separating member is heated by conduction of heat from the heating-supporting member when the separating member is slid. The image forming substance on the image holding member then comes in contact with a surface of the separating member so that the image forming substance is softened or melted. The separating member on the surface of the heating-supporting member and the image holding member are supported and come in press contact with each other by the press contact member between this surface and the press contact member. The image holding member is separated from the separating member surface by using curvature in the curvature separating portion formed on the downstream side of the heating-supporting member in the moving direction of the separating member. In this separation, the image forming substance is separated and removed from the image holding member. The curvature separating portion is located in a position in which no image forming substance is cooled and solidified. Accordingly, when the image holding member is separated from the separating member, the image forming substance is maintained in a softened or melted state. Therefore, adhesive force of the image forming substance with respect to the separating member surface can be greatly reduced in comparison with adhesive force of the image forming substance with respect to the image holding member.

A radius of curvature of the curvature separating portion is preferably set to be equal to or smaller than 4 mm to reliably separate the image holding member from the separating member surface by using this curvature.

In the fourth construction of the present invention, the planar portion is formed on a surface of the heating-supporting member coming in press contact with the elastic member roller used as the press contact member. Accordingly, a press contact portion of the elastic member roller can be formed on the same plane as a conveying path of the image holding member.

Further, a length of the planar portion in the moving direction of the separating member is set to be equal to a length of the press contact portion between the elastic member roller and the heating-supporting member in this moving direction. Accordingly, the curvature separating portion can be formed in an end portion of the press contact portion. Therefore, the image holding member can be separated from the separating member surface in a higher temperature region. Thus, adhesive force of the image forming substance with respect to the separating member surface can be further greatly reduced in comparison with adhesive force of the image forming substance with respect to the image holding member.

A tapered portion is formed on the surface of the heating-supporting member such that the tapered portion is lowered from an end portion of the press contact portion on an upstream side in the moving direction of the separating member toward this upstream side. The separating member is slid and moved in the planar portion and the tapered portion on the surface of the heating-supporting member. Therefore, when a liquid is provided to the image holding member, the liquid tending to be collected in an inlet port of the press contact portion can be sequentially discharged along a surface of the tapered portion.

In the fifth construction of the present invention, the heating-supporting member is constructed by a high thermal conductor having a high thermal conductive property so that a time for heating the heating-supporting member to a predetermined temperature is shortened. Accordingly, a warm-up time of the heating-supporting member is shortened and responsibility to a temperature adjustment of the heating-supporting member is improved.

A heat loss caused by transmission of heat from the heating-supporting member can be reduced by arranging a holder for holding the heating-supporting member through an insulator.

In the sixth construction of the present invention, the removing apparatus further has a temperature detecting means for detecting a temperature of the separating member surface just after the image holding member is separated from the separating member. Accordingly, a change in temperature of the separating member can be detected directly and instantly in the vicinity of a curvature separating position of the image holding member. Therefore, results of this temperature detection can be used in temperature control of the separating member by the heating-supporting member in the vicinity of the curvature separating position. The temperature detecting means may be arranged in a central portion of the image holding member in a width direction perpendicular to the moving direction of the separating member. In this case, when the image holding member is located in a center in the width direction of the separating member at any time and is conveyed, a temperature of the separating member corresponding to the central portion of the image holding member in the width direction can be detected even when a width of the image holding member is changed.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a method and an apparatus for removing an image forming substance from an image holding member will next be described in detail with reference to the accompanying drawings.

In the following embodiments, the present invention is applied to a toner removing apparatus for removing thermally melted toner as an image forming substance from a sheet of transfer paper as an image holding member having an image formed by an electrophotographic copying machine of a transfer type.

Figure 2:
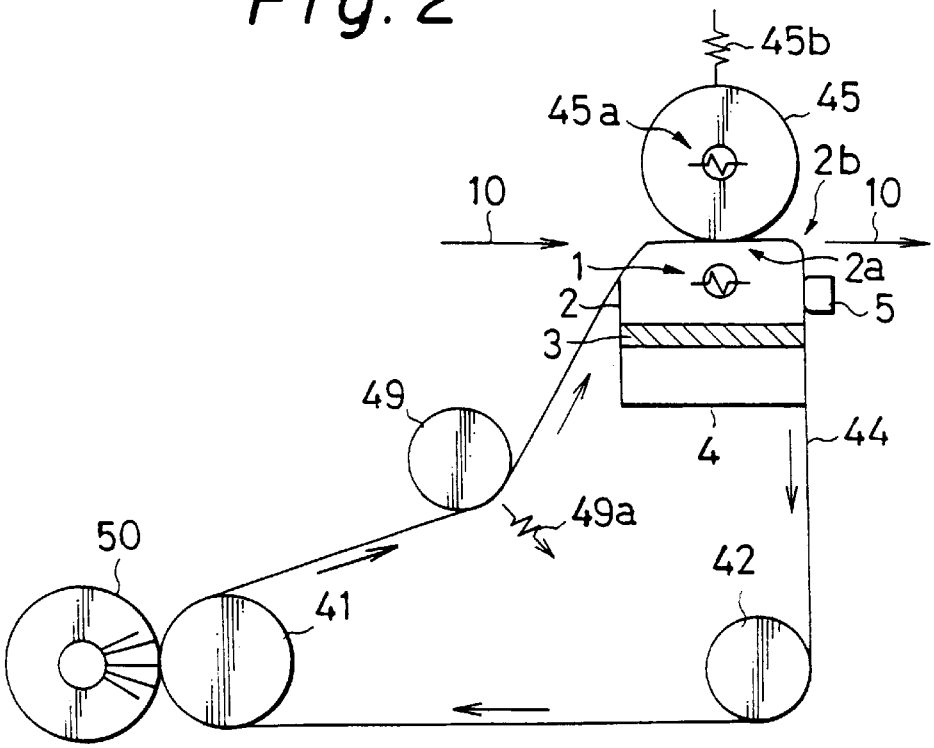
FIG. 2 is a front view schematically showing the construction of a toner separating unit in a toner removing apparatus in accordance with an embodiment of the present invention.

FIG. 2 is a front view schematically showing the construction of a toner separating unit in a toner removing apparatus in accordance with an embodiment of the present invention. This toner separating unit has a plurality of supporting rollers 41, 42, a belt 44 for a toner offset (called an offset belt in the following description), a heating roller 45, a tension roller 49 and a rotating brush roller 50. The offset belt 44 is arranged as a separating member having a belt shape and wound around a heating-supporting member 2 having a heater 1 therein as a heating means. The heating roller 45 has a heating lamp 45*a* therein and is arranged such that the heating roller 45 comes in press contact with the heating-supporting member 2 by a biasing means 45*b* such as a spring through the offset belt 44. The tension roller 49 is biased by a biasing means 49*a* such as a spring such that a belt portion between the supporting roller 41 and the heating-supporting member 2 is pressed inside. The rotating brush roller 50 removes toner from a surface of the offset belt 44.

At least the surface of the offset belt 44 is formed by a material having adhesive force stronger than that between the surface of a transfer paper sheet 10 and softened or melted toner. The offset belt 44 can be constructed by a plurality of layers such that at least one of these layers is set to a heat resisting layer having excellent strength and heat resisting property and a layer coming in contact with the toner is set to an adhesive layer having an excellent adhesive property with respect to this toner. In this case, the offset belt 44 has an excellent adhesive property and an excellent durable property with respect to the toner. The above heat resisting layer can be formed by a material using polyimide resin. The above adhesive layer can be formed by using a high molecular material such as ethylene terephthalate, polyethylene terephthalate, polystyrene, acrylic resin, methacrylic resin, styrene-butylacrylic copolymer, styrene-butadiene copolymer, polyester, epoxy resin, polyimide resin, etc.

The supporting roller 42 rotated by an unillustrated drive motor is used as a driving means of the offset belt 44. The offset belt 44 is moved at a moving speed approximately equal to a conveying speed of the transfer paper sheet 10 through frictional force between the offset belt 44 and the rotating supporting roller 42.

Figure 3A:
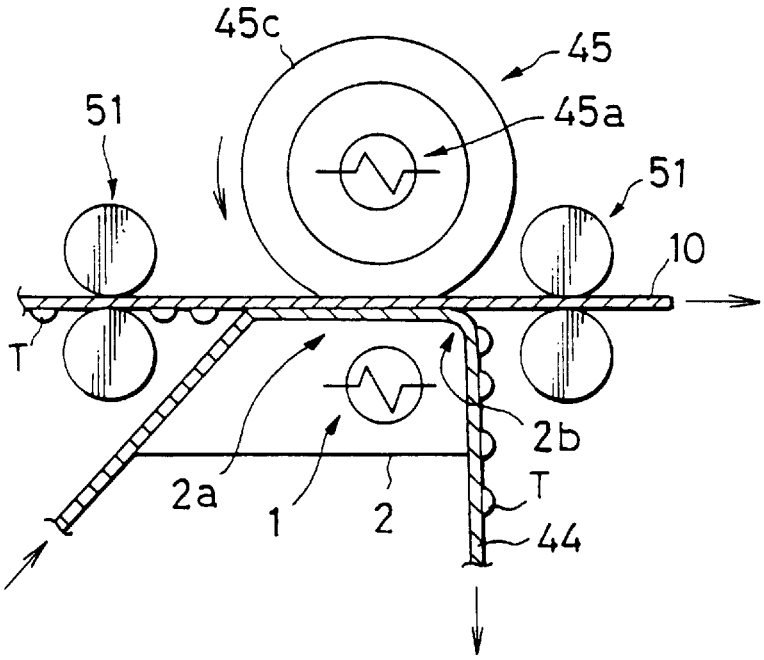
FIG. 3*a* is a front view of a main portion of the toner separating unit shown in FIG. 2.

FIG. 3*a* is an enlarged view of the heating roller 45 and the heating-supporting member 2. A surface portion of the heating roller 45 is constructed by an elastic member layer 45*c* so that a toner image face having toner T attached onto the transfer paper sheet 10 comes in close contact with the offset belt 44. The heating roller 45 is heated by the heating lamp 45*a* and is used together with the heating-supporting member 2 having the heater 1 therein to heat and soften or melt the toner attached onto the transfer paper sheet 10.

Figure 3B:
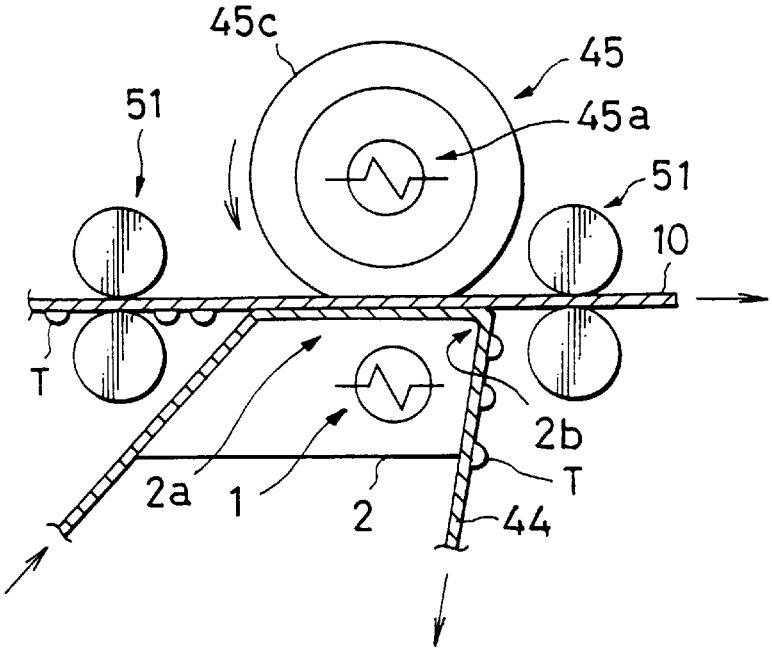
FIG. 3*b* is a front view of a main portion of one modified example of the toner separating unit shown in FIG. 2.
Figure 4:
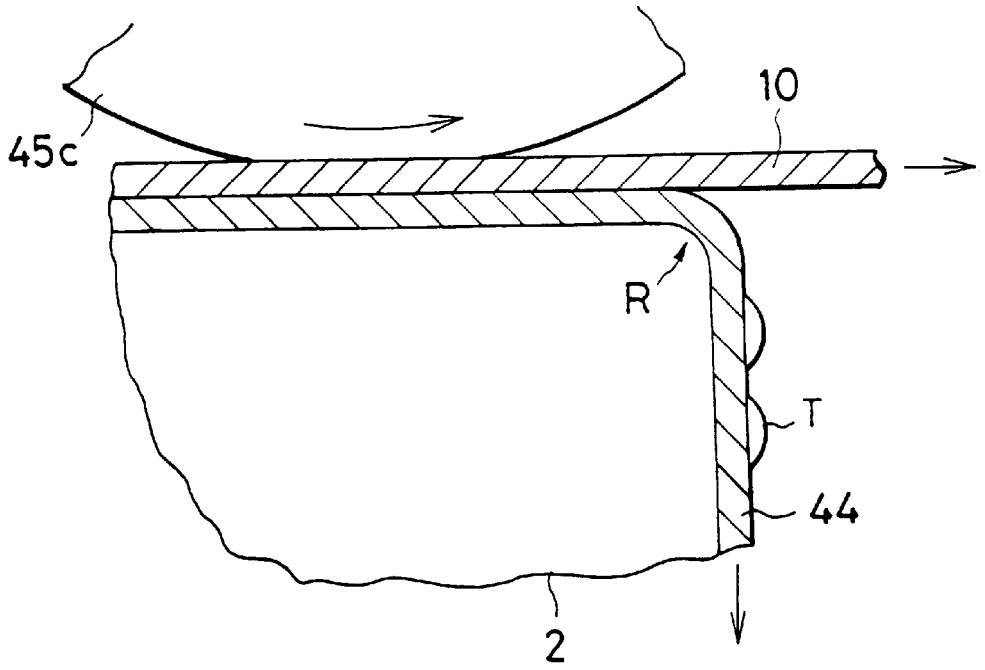
FIG. 4 is an enlarged view of a bent portion of a heating-supporting member.

In this embodiment, a planar portion 2*a* is formed on the surface of a press contact portion of the heating-supporting member 2 coming in press contact with the heating roller 45. Accordingly, this press contact portion has the same plane as a conveying path of the transfer paper sheet 10 so that generation of a jam and wrinkles of the transfer paper sheet 10 can be reduced within this conveying path. Further, a bent portion 2*b* having a bending angle of about 90 degrees is formed on a downstream side from the press contact portion of the heating-supporting member 2 in a conveying direction of the transfer paper sheet 10. The offset belt 44 is slidably moved along a surface of this bent portion 2*b*. The offset belt 44 is bent at a sharp angle in this bent portion 2*b* and is then moved so that the transfer paper sheet 10 is separated from a surface of the offset belt 44. As shown in FIG. 3*b*, the bent portion 2*b* of the heating-supporting member 2 may be formed at a sharper angle such that the offset belt 44 is bent at a sharper angle. Thus, a separating property of the transfer paper sheet 10 can be further improved. As shown in FIG. 4, a radius R of curvature of the bent portion 2*b* of the heating-supporting member 2 is preferably set to be equal to or smaller than 4 mm. In this case, the transfer paper sheet 10 can be more reliably separated from the surface of the offset belt 44 so that a defect (jam) in conveyance of the transfer paper sheet 10 can be reduced.

The planar portion 2*a* of the heating-supporting member 2 is extended until an upstream side in the conveying direction of the transfer paper sheet 10. The offset belt 44 is preliminarily heated in this extended planar portion. Heating efficiency for softening or melting the toner in the above press contact portion can be improved by this preliminary heating so that power of the toner removing apparatus can be saved.

The heating-supporting member 2 is preferably formed by a high thermal conductor having a high thermal conductive property. For example, this high thermal conductor is constructed by using a metallic material such as aluminum, stainless steel, etc. When such a high thermal conductor is used, a temperature rising time of the heating-supporting member 2 can be shortened so that a warm-up time of the heating-supporting member 2 can be shortened. Further, responsibility to a temperature adjustment of the heating-supporting member 2 is improved so that the temperature of a surface of the heating-supporting member 2 can be stabilized.

Figure 1:
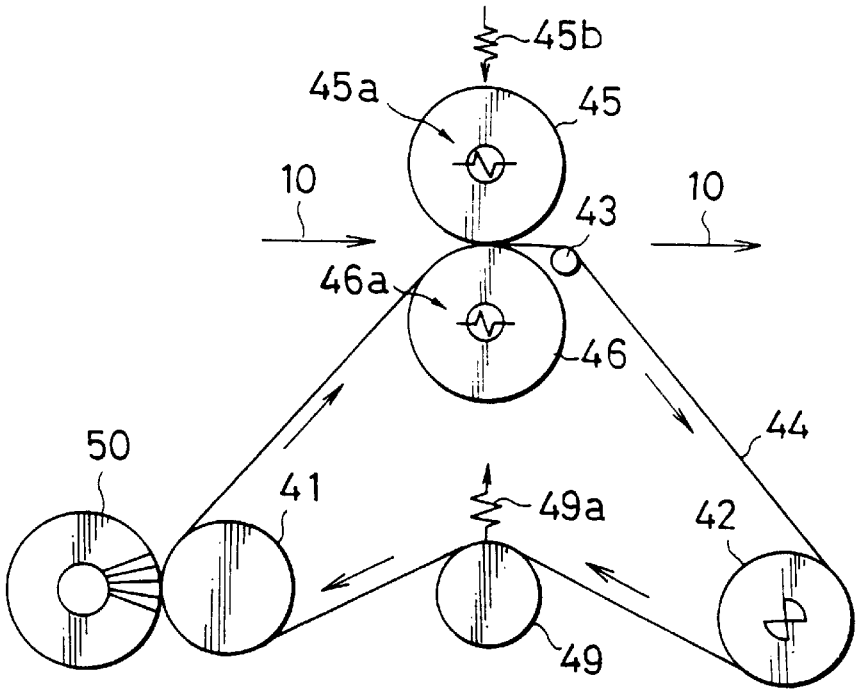
FIG. 1 is a front view schematically showing the construction of a toner separating unit in a toner removing apparatus as a general example.

The heating-supporting member 2 is held by a holding member 4 through an insulator 3 (see FIG. 1). A transmission (radiation) loss of heat from the heating-supporting member 2 can be reduced by this insulator 3 so that the heating efficiency of the heating-supporting member 2 can be further improved.

When radiant heat of an infrared lamp, etc. is used as a heating means of the heating-supporting member 2, it is preferable to arrange a reflecting layer between the heating-supporting member 2 and the insulator 3. This reflecting layer may be constructed by an aluminum evaporation layer, an aluminum plate, a mirror, etc. In this case, a moving amount of the radiant heat moved to the insulator 3 can be reduced and the radiant heat can be concentrated onto the heating-supporting member 2. Accordingly, it is possible to effectively use heat from a radiant light source such as the infrared lamp, etc.

It is preferable to perform low frictional processing on a contact surface of the heating-supporting member 2 coming in contact with the offset belt 44. This low frictional processing is constructed by film formation of a fluorine resin layer, taflum processing, etc., but is not limited to these processings. Frictional resistance between the offset belt 44 and a surface of the heating-supporting member 2 is reduced by such low frictional processing. Accordingly, driving force (torque) of the offset belt 44 can be reduced so that wearing of the offset belt 44 can be reduced and a life of the offset belt 44 can be extended.

A temperature sensor 5 such as a thermistor is attached to the heating-supporting member 2 as a temperature detecting means for detecting a surface temperature of the offset belt 44 in the vicinity of the bent portion 2*b* in the conveying direction of the transfer paper sheet 10. The temperature of the offset belt 44 near the bent portion 2*b* can be detected directly and instantly by this temperature sensor 5. A detecting signal of this temperature is transmitted to an unillustrated control section. A heating operation of the heater 1 is controlled on the basis of results of this temperature detection such that the temperature of the offset belt 44 is stabilized. An attaching position of the temperature sensor 5 is set to a central portion of the offset belt 44.

In the toner removing apparatus constructed above, a transfer paper sheet 10 is fed from an unillustrated paper feed unit and is conveyed by conveying rollers 51 and an unillustrated conveying guide member such that a toner image face having attached toner T comes in contact with a surface of the offset belt 44. The transfer paper sheet 10 is then supported by the heating-supporting member 2 while the transfer paper sheet 10 comes in slide contact with the heating-supporting member 2. The transfer paper sheet 10 is conveyed such that the transfer paper sheet 10 passes through a press contact portion between the heated offset belt 44 and the heating roller 45 heated by the heating lamp 45*a*. At this time, the toner T on the transfer paper sheet 10 comes in press contact with the surface of the offset belt 44 in a state in which this toner T is softened or melted. The transfer paper sheet 10 reaches the bent portion 2*b* of the heating-supporting member 2 before the toner T is cooled and solidified while this toner T is maintained in a softened or melted state. In this bent portion 2*b*, the transfer paper sheet 10 is separated from the surface of the offset belt 44. In this case, the toner T on the transfer paper sheet 10 is separated from the surface of the transfer paper sheet 10 while this toner T is attached onto the surface of the offset belt 44. The transfer paper sheet 10 separating the toner therefrom is conveyed and discharged to an unillustrated paper discharging unit by the conveying roller 51, etc.

In this embodiment, heating of the toner T is maintained until the transfer paper sheet 10 is separated from the offset belt 44. The transfer paper sheet 10 is separated from the offset belt 44 before the toner T is cooled and solidified. Accordingly, the toner T can be maintained in the softened or melted state at a separating time and adhesive force of the toner T with respect to the surface of the offset belt 44 can be greatly reduced in comparison with adhesive force of the toner T with respect to the transfer paper sheet 10. Therefore, toner separating performance of the offset belt 44 can be greatly improved.

Further, it is not necessary to separately arrange a separating roller for separating the transfer paper sheet by using curvature as in the general toner removing apparatus.

The toner removing apparatus in the above embodiment may have a liquid providing unit for providing an unstabilizing liquid for unstabilizing the adhesive force between the toner and the transfer paper sheet 10 to the transfer paper sheet 10 before separating processing using the toner separating unit. In the following description, this unstabilizing liquid is called a processing liquid. This processing liquid can be constructed by using at least one kind of water or aqueous solution selected from a group of water, an aqueous solution including a surfactant, an aqueous solution including a water-soluble polymer, and an aqueous solution including a surfactant and a water-soluble polymer. There is a case in which the transfer paper sheet 10 includes the processing liquid after the toner is separated and removed from the transfer paper sheet 10 having the provided processing liquid. Accordingly, a drying unit for drying this transfer paper sheet 10 may be arranged in accordance with necessity. As mentioned above, the processing liquid is provided to the transfer paper sheet 10 before a toner separating process so that a toner separating property can be further improved.

Figure 5:
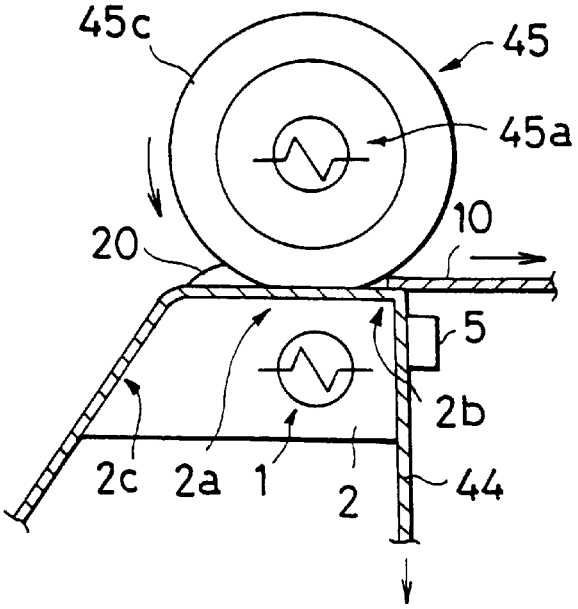
FIG. 5 is a view for explaining collection of a liquid caused when the liquid is provided to a transfer paper sheet.
Figure 6A:
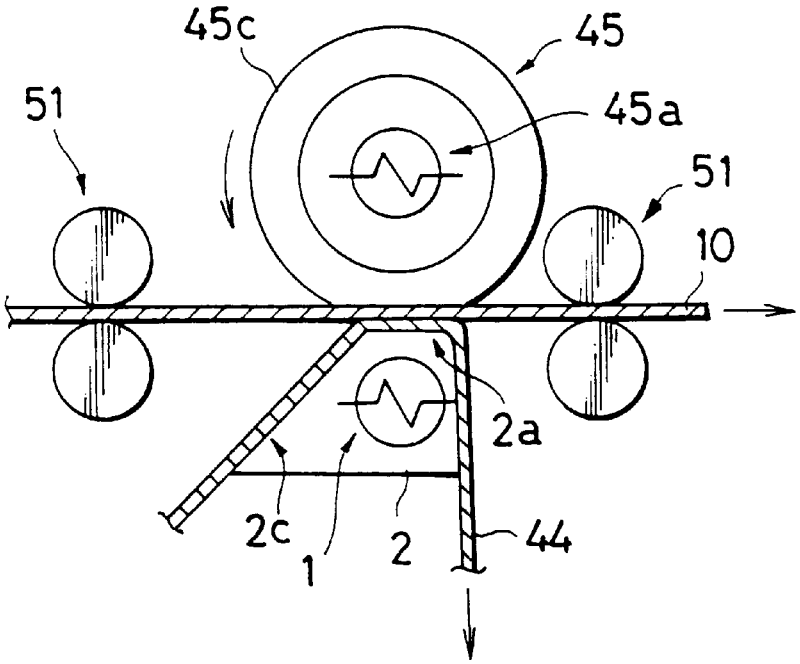
FIG. 6*a* is a front view of a main portion of another modified example of the toner separating unit.
Figure 6B:
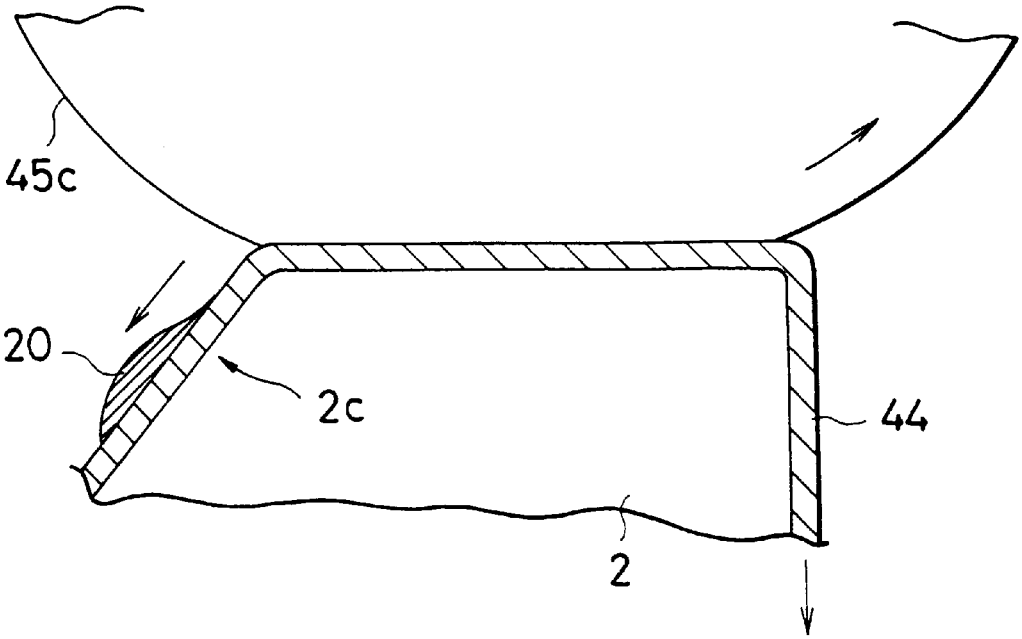
FIG. 6*b* is an enlarged view of a press contact portion between the heating-supporting member and a heating roller in the main portion shown in FIG. 6*a;*

When the processing liquid is provided to the transfer paper sheet 10 as mentioned above, there is a case in which the processing liquid 20 is collected on the downstream side of a press contact portion between the heating roller 45 and the heating-supporting member 2 as shown in FIG. 5 since the processing liquid is wrung out of the transfer paper sheet 10 by press contact force in the press contact portion. When such collection of the processing liquid 20 is caused, a rise in temperature of the offset belt 44 is prevented so that thermal efficiency of the offset belt 44 at a heating time is reduced. As shown in FIG. 6*a*, to prevent generation of this liquid collection in advance, a length of the planar portion 2*a* of the heating-supporting member 2 in the conveying direction of the transfer paper sheet is preferably set to be approximately equal to the length of a nipping portion as the press contact portion of the elastic member layer 45*c* of the heating roller 45. Further, it is preferable to form a tapered portion 2*c* lowered from an upstream side end portion of the planar portion 2*a* toward a further upstream side so as to prevent the generation of the liquid collection in advance. Thus, as shown in FIG. 6*b*, the processing liquid 20 wrung out of the transfer paper sheet 10 in the press contact portion of the heating roller 45 can be sequentially discharged along the tapered portion 2*c* of the heating-supporting member 2.

Figure 7:
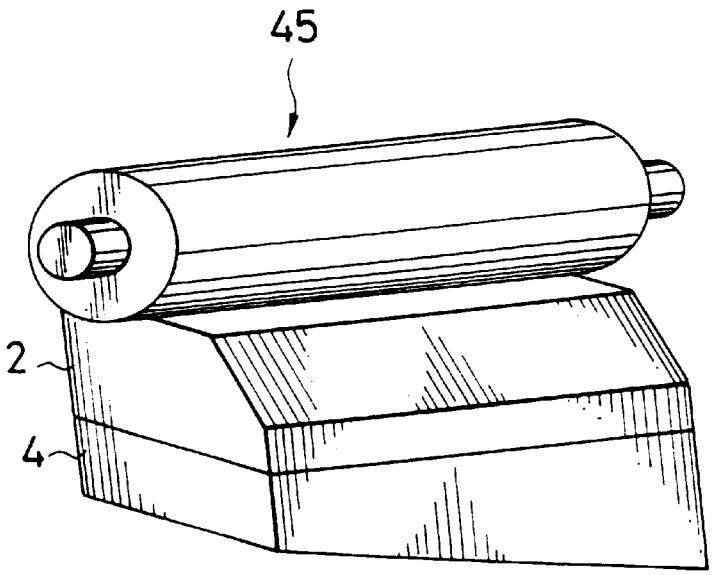
FIG. 7 is a perspective view of a main portion of another modified example of the toner separating unit.

As shown in FIG. 7, the planar portion 2*a* may be inclined from a horizontal position in a direction perpendicular to the conveying direction of the transfer paper sheet so as to prevent the above liquid collection instead of the above structure in which the length of the planar portion 2*a* of the heating-supporting member 2 is set to be equal to the length of the nipping portion of the heating roller 45. In this case, the processing liquid 20 wrung out of the transfer paper sheet 10 in the press contact portion of the heating roller 45 naturally flows toward a lower inclination (on a left-hand side in FIG. 7) by inclining the planar portion 2*a* of the heating-supporting member 2 so that this processing liquid 20 can be discharged.

Figure 8:
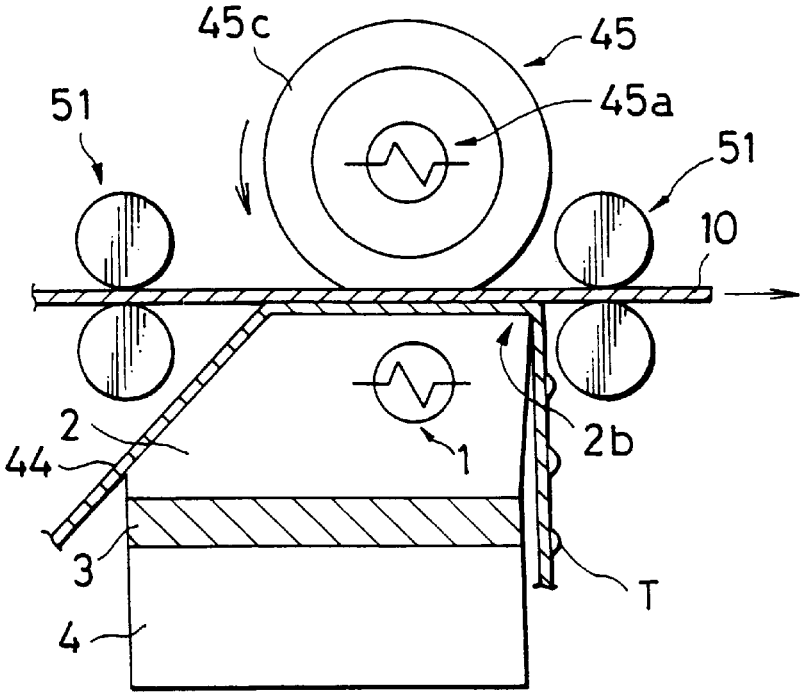
FIG. 8 is a front view of a main portion of another modified example of the toner separating unit.

In the above embodiment, as shown in FIG. 8, a face of the heating-supporting member 2 on a downstream side from the bent portion 2*b* may be constructed such that this face does not come in contact with the offset belt 44. In this construction, the area of a sliding region between the offset belt 44 and the heating-supporting member 2 is reduced so that frictional resistance between the offset belt 44 and the heating-supporting member 2 can be reduced. Accordingly, driving force (torque) of the offset belt 44 is reduced so that wearing of the offset belt 44 can be reduced and a life of the offset belt 44 can be extended.

Figure 9:
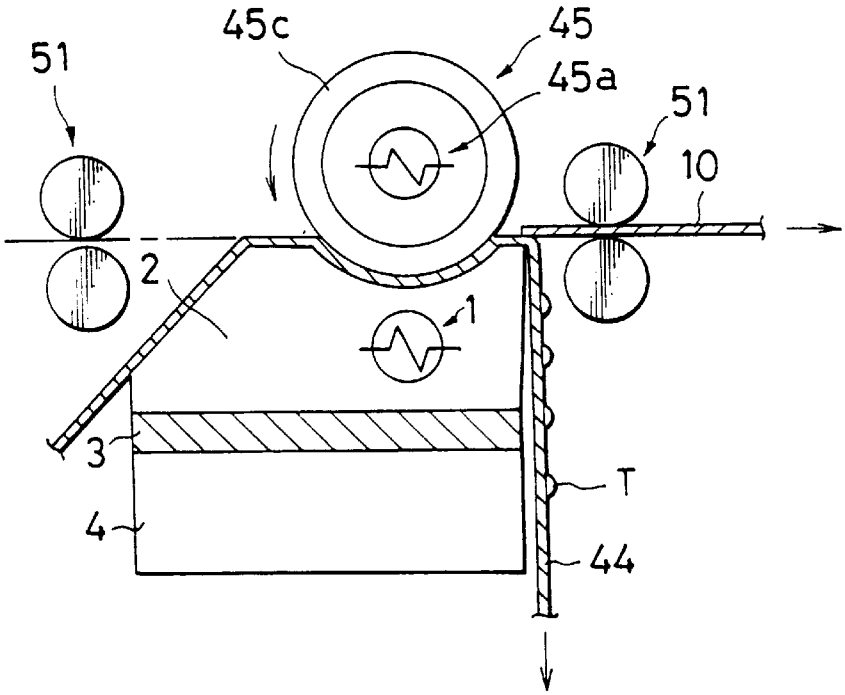
FIG. 9 is a front view of a main portion of another modified example of the toner separating unit.

In the above embodiment, as shown in FIG. 9, a surface of the press contact portion of the heating-supporting member 2 may be formed in an arc shape such that a radius of curvature of this arc surface is equal to a radius of curvature of an outer circumferential face of the heating roller 45. In this construction, the area of a contact region of the offset belt 44 coming in contact with the heating-supporting member 2 and the heating roller 45 is widened in comparison with the above case in which the heating roller 45 comes in press contact with the planar portion 2*a* of the heating-supporting member 2 as shown in FIG. 2. Accordingly, an amount of heat supplied to the transfer paper sheet 10 is increased. Therefore, if an amount of heat for softening or melting the toner is constant, outputs and heating temperatures of the heater 1 and the heating lamp 45*a* can be reduced so that power consumption of the toner removing apparatus can be reduced.

In the above embodiment, a surface of the heating-supporting member 2 between the press contact portion of the heating-supporting member 2 coming in press contact with the heating roller 45 and the bent portion of the heating-supporting member 2 on the downstream side may be irregularly formed in a direction perpendicular to the conveying direction of the transfer paper sheet. In this construction, after the transfer paper sheet 10 passes through the press contact portion of the heating-supporting member 2 coming in press contact with the heating roller 45, the transfer paper sheet 10 is deformed in a wavy shape when the transfer paper sheet 10 is moved along the above irregular surface. Accordingly, a slight shift is caused on an interface as an adhesive face between the offset belt 44 and the transfer paper sheet 10. Therefore, the offset belt 44 and the transfer paper sheet 10 are partially separated from each other on this interface. Since the offset belt 44 and the transfer paper sheet 10 are partially separated from each other before curvature separation in the above bent portion, it is possible to reduce adhesive force between the offset belt 44 and the transfer paper sheet 10, namely, separating force of the transfer paper sheet 10. Accordingly, separating performance of the transfer paper sheet using the above curvature separation can be improved. Therefore, the transfer paper sheet 10 can be stably conveyed in a separating position and generation of a jam of the transfer paper sheet can be prevented. The irregular surface of the heating-supporting member 2 may be formed such that irregularities of this irregular surface are distributed in the conveying direction of the transfer paper sheet.

Figure 10:
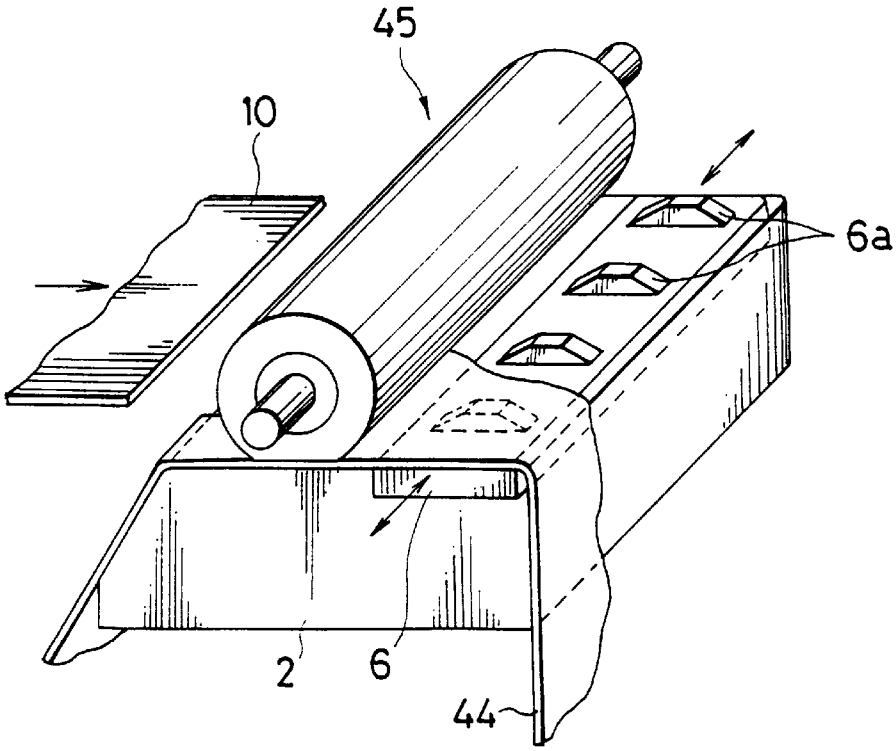
FIG. 10 is a perspective view of a main portion of another modified example of the toner separating unit.

As shown in FIG. 10, recessed-projected portions 6*a* may be formed in a direction perpendicular to the conveying direction of the transfer paper sheet on a surface of the heating-supporting member 2 between the press contact portion of the heating-supporting member 2 coming in press contact with the heating roller 45 and the bent portion on the downstream side. Further, a movable member 6 may be inserted onto this surface such that this movable member 6 is reciprocated in an arrow direction in FIG. 10. In this construction, a region of partial separation of the transfer paper sheet 10 can be enlarged by reciprocating the movable member 6. Accordingly, a separating property of the transfer paper sheet 10 can be further improved and the transfer paper sheet 10 can be more stably conveyed and the generation of a jam can be further prevented.

Figure 11:
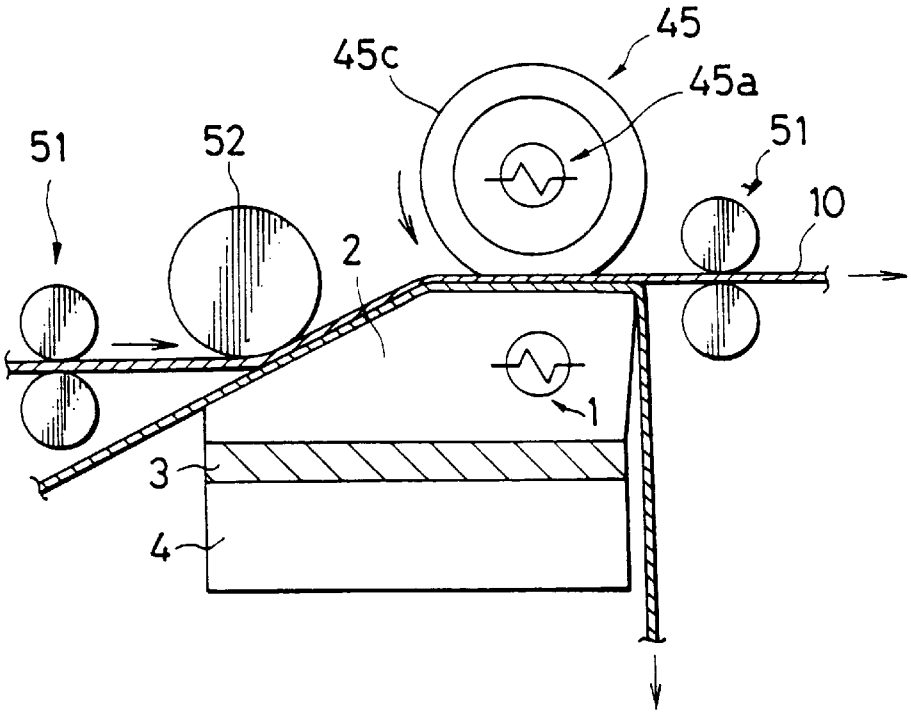
FIG. 11 is a front view of a main portion of another modified example of the toner separating unit.

In the above embodiment, as shown in FIG. 11, the toner removing apparatus may be constructed such that a toner image face of the transfer paper sheet 10 also comes in contact with a surface of the offset belt 44 in a tapered portion of the heating-supporting member 2 on the upstream side from the press contact portion of the heating-supporting member 2 coming in press contact with the heating roller 45. In the example of FIG. 11, a backup roller 52 for pressing the transfer paper sheet 10 against the surface of the offset belt 44 is arranged in this tapered portion. In this construction, a heating distance of the transfer paper sheet 10 can be lengthened in comparison with a construction in which the transfer paper sheet 10 comes in contact with only a surface of the offset belt 44 on the planar portion 2*a* of the heating-supporting member 2. Accordingly, heating efficiency of the transfer paper sheet 10 is improved by preliminary heating effects in this tapered portion so that power of the toner removing apparatus can be saved.

Figure 12:
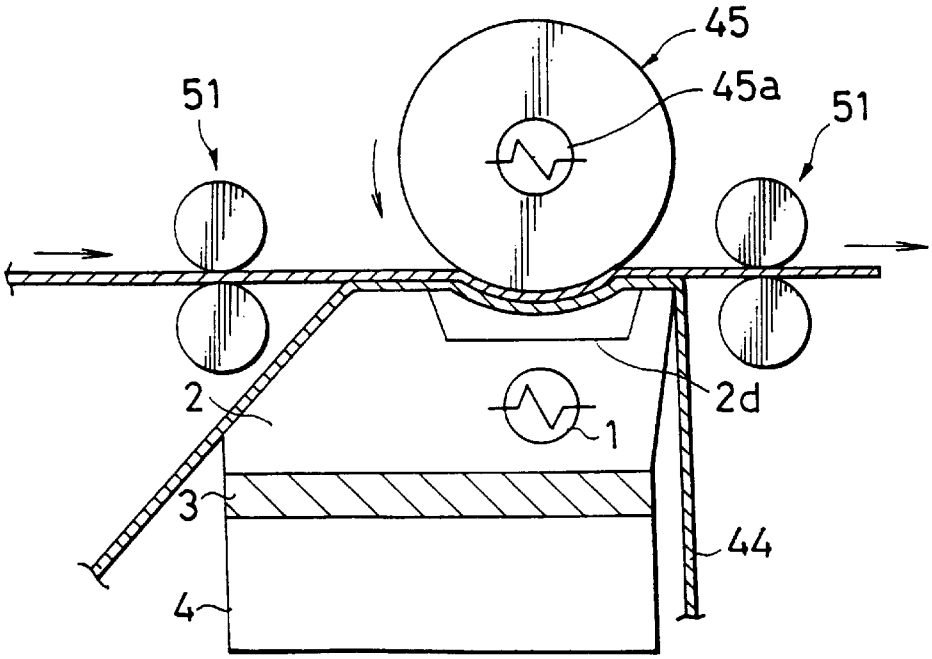
FIG. 12 is a front view of a main portion of another modified example of the toner separating unit.

As shown in FIG. 12, a heating roller 45 as an inelastic member having no elastic member layer 45*c* in a surface portion thereof may be used in the above embodiment. In this case, only a surface portion of the heating-supporting member 2 coming in press contact with the heating roller 45 may be formed by an elastic member 2*d*. In this construction, a region (volume) of the elastic member can be greatly reduced in comparison with the case in which the heating roller 45 having the elastic member layer 45*c* in the surface portion thereof is used. Accordingly, supply (transmission) of heat transmitted from the heating roller 45 to the press contact portion is improved so that thermal efficiency can be improved and power of the toner removing apparatus can be saved. Further, since the elastic member 2*d* is simply formed in only the surface portion of the heating-supporting member 2 coming in press contact with the heating roller 45, parts of the toner removing apparatus can be simply manufactured so that cost of the toner removing apparatus can be reduced.

In the construction shown in FIG. 12, it is preferable to construct the elastic member 2*d* by a plurality of layers such that a heat resisting layer is used as at least one of these plural layers and a mold-releasing layer is used as a surface layer coming in contact with the offset belt 44. A material of the above heat resisting layer can be constructed by using silicon rubber, etc. A material of the above mold-releasing layer can be constructed by using polytetrafluoethylene, etc. When such a multilayer structure is used, sliding resistance between the offset belt 44 and the elastic member 2*d* can be reduced while elasticity is secured in the press contact portion. Further, heat resistance and durability of the elastic member 2*d* can be improved.

In the above embodiment, the offset belt 44 having an endless shape is used. However, when such an endless belt is used, a shift in moving direction of the offset belt 44 is easily caused and wrinkles of the offset belt 44 are easily caused in accordance with an accuracy of parts of a rotating shaft of each of the heating roller 45, the supporting rollers 41, 42, etc., a position accuracy of a mutual parallel degree of these rollers, etc.

Figure 13:
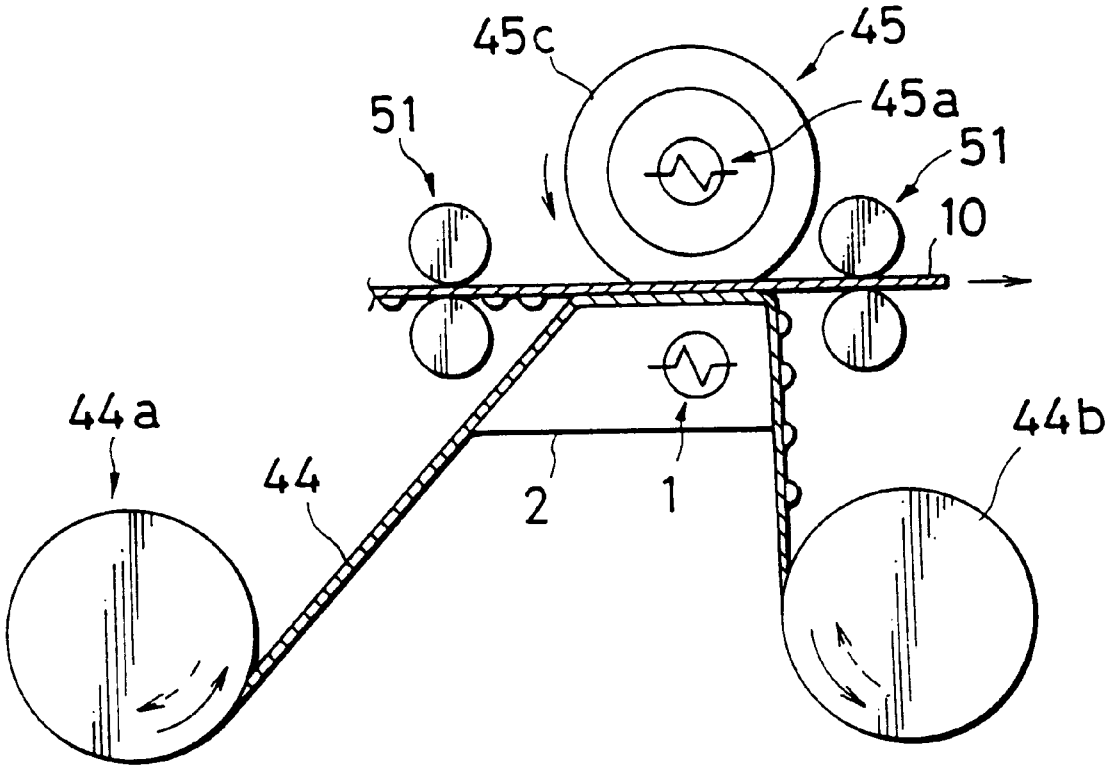
FIG. 13 is a front view of a main portion of another modified example of the toner separating unit.

An offset belt 44 having no endless shape (as an offset belt having terminal ends) is used to avoid such problems as shown in FIG. 13. Further, a supplying roll 44*a* and a winding roll 44*b* of this offset belt 44 are also arranged. When toner is removed from the transfer paper sheet, the offset belt 44 is wound around the winding roll 44*b*. In contrast to this, when no toner is removed from the transfer paper sheet, the offset belt 44 is rewound around the supplying roll 44*a*. The offset belt 44 may be wound and rewound by an unillustrated driving means. In this construction, after a predetermined amount of the offset belt 44 is wound around the winding roll 44*b*, an inverse rewinding operation of the offset belt 44 is performed through the same member as the winding member at a winding time. Therefore, a slight shift in position of the offset belt at the winding time is corrected every rewinding operation. Accordingly, running stability of the offset belt is excellent in comparison with an endless belt in which the above shift is accumulated and wrinkles of the endless belt, etc. tend to be caused. Hence, a stable running operation of the offset belt 44 can be performed for a long period.

When the offset belt 44 is rewound in the construction of FIG. 13, it is preferable to control the operation of a biasing means such that press contact force of the heating roller 45 is released. In this case, the press contact force applied to the offset belt 44 at a rewinding time is removed so that driving force at the rewinding time is reduced. Accordingly, the offset belt 44 can be rapidly rewound with small driving force.

In the above embodiment, the present invention is applied to the transfer paper sheet 10 having an image formed by an electrophotographic copying machine of a transfer type. However, the present invention can be also applied to an image holding member such as a sheet of recording paper used in another image forming apparatus such as a facsimile telegraph, a printer, etc. The present invention is not limited to the image holding member having a fibrous structure, but can be applied to an image holding member on which an image can be formed. For example, the image holding member usable in the present invention may be constructed by a laminated material, etc. in which a surface layer of a base sheet such as a plastic layer is formed by a material layer of paper, etc.

Figure 14:
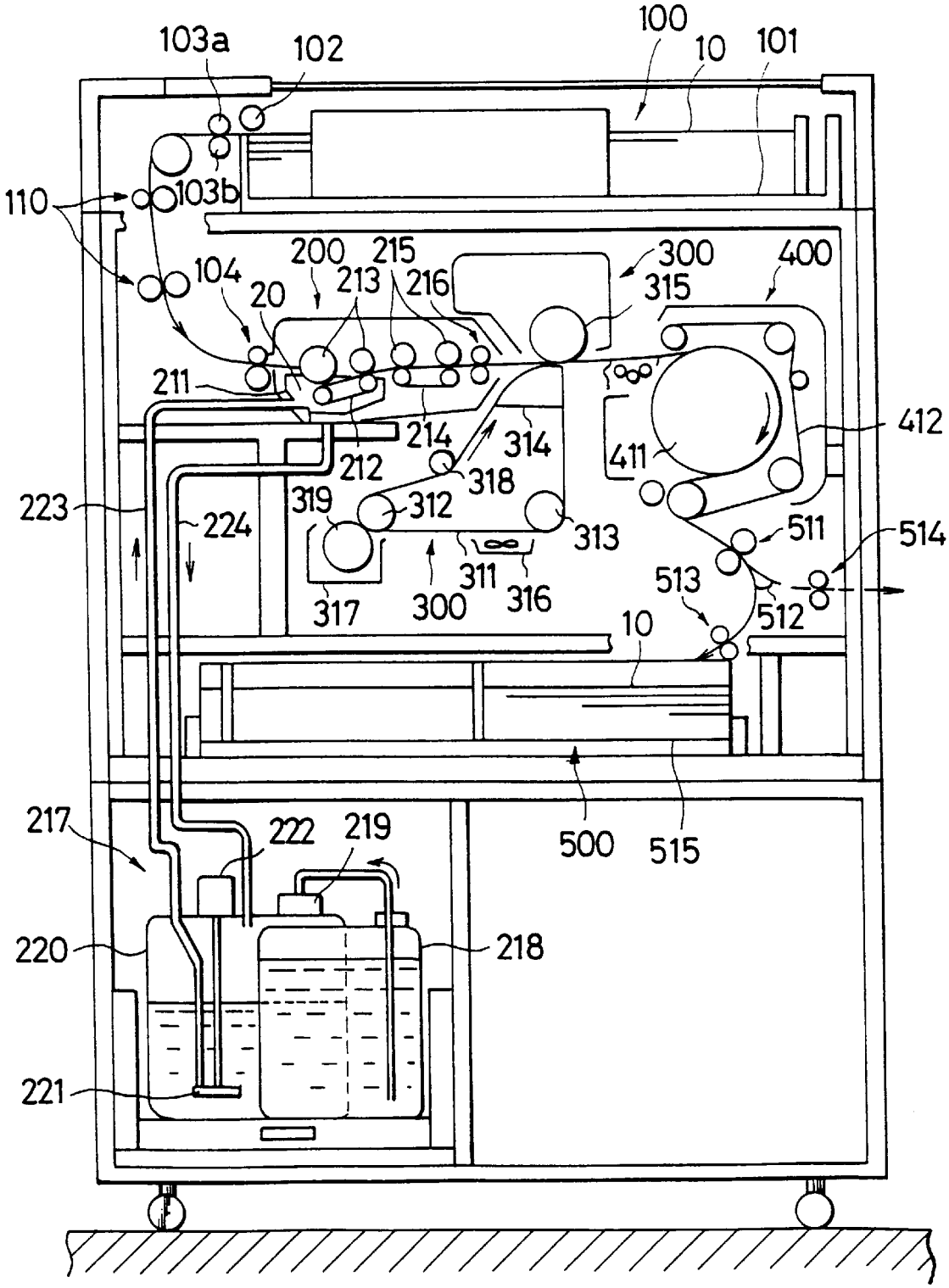
FIG. 14 is a front view schematically showing the construction of a toner removing apparatus to which the present invention can be applied.

FIG. 14 shows an example of the construction of a toner removing apparatus to which the present invention can be applied.

This toner removing apparatus has a paper feed unit 100, a liquid providing unit 200, a toner separating unit 300, a drying unit 400 and a paper receiving unit 500. The paper feed unit 100 separates transfer paper sheets 10 stored in a stacking state and having toner images from each other and feeds these transfer paper sheets one by one. The liquid providing unit 200 supplies the above processing liquid 20 to one transfer paper sheet 10 fed from the paper feed unit 100. The toner separating unit 300 separates and removes toner from the transfer paper sheet 10 having the supplied processing liquid 20. The drying unit 400 dries the transfer paper sheet 10 removing the toner therefrom. The paper receiving unit 500 receives the transfer paper sheet 10 discharged from the drying unit 400.

The paper feed unit 100 feeds the transfer paper sheets 10 stacked on a bottom plate 101 from an uppermost paper sheet by a paper feed roller 102. In this paper feed unit 100, overlapped paper sheets are separated from each other by a separating mechanism composed of a feed roller 103*a* and a separating roller 103*b*. Thus, the paper feed unit 100 feeds only one transfer paper sheet 10. The transfer paper sheet 10 fed from this paper feed unit 100 is conveyed by conveying roller pairs 110 and is fed to the next liquid providing unit 200 by making a timing adjustment and a skew correction of this transfer paper sheet by a resist roller pair 104.

The liquid providing unit 200 has a liquid container 211, a liquid interior belt conveying section 212, brush rollers 213, a belt conveying section 214, brush rollers 215, a wringing roller pair 216, a liquid supplying device 217 and an unillustrated driving section. The liquid container 211 is filled with a predetermined amount of the processing liquid 20. The liquid interior belt conveying section 212 is constructed by a round belt and is wound around supporting rollers in a state in which the liquid interior belt conveying section 212 is dipped into the processing liquid 20 of the liquid container 211. The liquid interior belt conveying section 212 is rotated in this state. The brush rollers 213 are arranged such that these brush rollers 213 are opposed to the liquid interior belt conveying section 212 through the transfer paper sheet 10. The belt conveying section 214 and the brush rollers 215 are arranged such that the transfer paper sheet 10 having the provided liquid is conveyed. The wringing roller pair 216 removes a surplus amount of the processing liquid 20 provided to the transfer paper sheet 10. The liquid supplying device 217 supplies the processing liquid 20 to the liquid container 211. The unillustrated driving section operates the above liquid interior belt conveying section 212, etc.

The above liquid supplying device 217 is constructed by an exchangeable replenishing liquid bottle 218, a tank 220, a liquid supplying pump 221, a pump motor 212, a liquid supplying pipe 223, a liquid discharging pipe 224, etc. The processing liquid 20 is suitably supplied from the replenishing liquid bottle 218 to the tank 220 by an electromagnetic pump 219. The liquid supplying pump 221 is built in the tank 220 and is constructed by a blade pump, etc. The pump motor 212 rotates the liquid supplying pump 221. The liquid supplying pipe 223 is arranged to supply the processing liquid 20 from the liquid supplying pump 221 to the liquid container 211. The liquid discharging pipe 224 is arranged such that the processing liquid 20 discharged from a discharging port formed in a lower portion of the liquid container 211 is returned into the tank 220. In this construction, the processing liquid 20 supplied by the liquid supplying pump 221 is supplied to the liquid container 211 through the liquid supplying pipe 223. The processing liquid 20 discharged from the discharging port of the liquid container 211 is returned into the tank 220 through the liquid discharging pipe 224 so that the processing liquid 20 is circulated. When the processing liquid 20 is steadily circulated, an amount of the processing liquid supplied by the liquid supplying pump 221, etc. are set such that the liquid interior belt conveying section 212 is dipped into the processing liquid 20 within the liquid container 211.

The toner separating unit 300 has an offset belt 311, a heating block 314, an upper heating roller 315, a blowing fan 316, a cleaner 317 and a wiping roller 318. The offset belt 311 is arranged as a separating member having a belt shape and wound around a plurality of supporting rollers 312, 313, etc. Each of the heating block 314 and the upper heating roller 315 has a heating lamp therein and is arranged such that the heating block 314 and the upper heating roller 315 come in press contact with each other through the offset belt 311. The blowing fan 316 is arranged as a means for cooling toner attached onto a surface of the offset belt 311. The cleaner 317 removes the toner from the surface of the offset belt 311. The wiping roller 318 wipes the surface of the offset belt 311 cleaned by the cleaner 317 and provides a predetermined tensile force to the offset belt 311.

As mentioned above, each of the heating block 314 and the upper heating roller 315 is used to make a toner image face of the transfer paper sheet 10 come in close contact with the offset belt 311 and is also used to heat and soften the toner fixed to the transfer paper sheet 10.

The offset belt 311 is formed by a material having adhesive force stronger than that between a surface of the transfer paper sheet 10 and the toner softened on a toner contact side surface of the offset belt. For example, the offset belt 311 is formed by a metallic material including aluminum, copper, nickel, etc., or a high molecular material such as polyethylene terephthalate (PET) having a diffused titanium oxide. When the high molecular material is used as a material of the surface of the offset belt, it is desirable to provide a multilayer structure having at least two layers of a base and a surface layer in view of prevention of extension caused by tension and heat, durability, etc.

A bent portion is formed on a downstream side in a moving direction of the offset belt 311 from a press contact portion of the heating block 314 coming in press contact with the upper heating roller 315. This bent portion has a predetermined radius of curvature set such that the moving direction of the offset belt 311 is approximately changed 90 degrees. The moving direction of the offset belt is rapidly changed around this bent portion so that the transfer paper sheet 10 is separated from the offset belt 311 by using curvature.

The toner on the offset belt 311 is heated by the heating block 314, etc. so that viscosity of this toner is increased. This toner is cooled by the blowing fan 316 so that the toner is solidified. Accordingly, this toner can be easily removed from the offset belt 311 by the cleaner 317.

The cleaner 317 mechanically separates and removes the toner attached onto a surface of the offset belt 311 by a brush roller 319 having a metallic brush on a surface thereof. For example, this metallic brush is constructed by a stainless loop brush. This brush roller 319 is biased by an unillustrated pressurizing spring toward the surface of the offset belt 311. A metallic blade may be arranged on a downstream side from this brush roller 319 in the moving direction of the offset belt 311.

The wiping roller 318 is constructed by a material capable of preferably providing wiping effects in at least a surface portion thereof. For example, the wiping roller 318 is formed by winding a cloth, etc. around a circumferential face of a body of the wiping roller 318. In this example, the wiping roller 80 is normally not rotated together with the offset belt surface and is rotated by a predetermined angle in suitable timing such that contact portions of the wiping roller 80 coming in contact with the offset belt surface can be replaced with each other. Thus, the wiping effects of the wiping roller 80 can be sufficiently obtained for a long period.

For example, the drying unit 400 dries the transfer paper sheet 10 such that a liquid holding amount of the transfer paper sheet 10 is equal to or smaller than 10% of a paper weight. The drying unit 400 is constructed by a heating drum 411 and a belt 412 for pressing the transfer paper sheet. For example, the heating drum 411 is made of aluminum and has a heating lamp therein. The paper pressing belt 412 is wound around a plurality of supporting rollers and is endlessly moved in a state in which the paper pressing belt 412 is wound around a circumferential face of the heating drum 411 by a constant angle. The paper pressing belt 412 can be constructed by using a material having a heat resisting property and a gas permeable property such as a cloth of canvas texture, cotton texture, Tetron texture, etc.

The transfer paper sheet 10 can be supported between the circumferential face of the heating drum 411 and an inner face of the offset belt with certain force such that the transfer paper sheet 10 shrinks in a completely free shape without any wrinkles and no transfer paper sheet 10 is easily curled and deformed in a wavy shape while the transfer paper sheet is dried in a winding region on the circumferential face of the heating drum.

The paper receiving unit 500 is constructed by a conveying roller pair 511, a branching claw 512, discharging roller pairs 513, 514, a built-in paper discharging tray 515, an unillustrated external paper discharging tray, etc. The conveying roller pair 511, etc. are arranged to convey the transfer paper sheet 10 from the drying unit 400. The toner removing apparatus is constructed such that the transfer paper sheet 10 can be selectively discharged onto the built-in paper discharging tray 515 or the external paper discharging tray in accordance with necessity. The built-in paper discharging tray 515 is slidably constructed such that this built-in paper discharging tray 515 can be pulled out on this side of the toner removing apparatus.

In the toner removing apparatus constructed above, the processing liquid 20 is uniformly provided by the liquid providing unit 200 onto a toner image face of the transfer paper sheet 10 fed from the paper feed unit 100. In FIG. 14, the toner image face is set to a lower face of the transfer paper sheet. This transfer paper sheet 10 is then fed to the toner separating unit 300. In this toner separating unit 300, toner fixed onto the transfer paper sheet 10 is softened by heat from each of the heating block 314 and the upper heating roller 315 so that this toner is attached onto a surface of the offset belt 311. When the transfer paper sheet 10 is separated from the offset belt 311 around the bent portion of the heating block 314, the toner attached onto the surface of the offset belt 311 is separated from the transfer paper sheet 10. Thus, this toner is removed from the transfer paper sheet 10. The transfer paper sheet 10 removing the toner therefrom is then dried by the drying unit 400. The dried transfer paper sheet 10 is discharged onto the built-in paper discharging tray 515 of the paper receiving unit 500 by the paper discharging roller pair 513. As mentioned above, a liquid is supplied to the transfer paper sheet 10 attaching the toner thereto, and the toner is separated from the transfer paper sheet 10 in a state in which this liquid permeates an interfacial portion between the transfer paper sheet 10 and the toner. Accordingly, the toner can be removed from the transfer paper sheet 10 without damaging paper fibers.

In the above toner removing apparatus, supporting-conveying means for conveying the transfer paper sheet as a recording sheet are constructed by the feed roller 103*a* and the separating roller 103*b* of the paper feed unit 100, the upper heating roller 315 and the offset belt 311 of the toner separating unit 300, and the heating drum 411 and the paper pressing belt 412 of the drying unit 400. The transfer paper sheet 10 is stressed and flexed in accordance with conveying speeds of the transfer paper sheet 10 set in these three supporting-conveying means so that the transfer paper sheet 10 is extended, cut and wrinkled in a conveying direction of the transfer paper sheet 10 and is folded and overlapped with wrinkles, etc.

The conveying speeds of the supporting-conveying means for supporting and conveying the transfer paper sheet 10 are switched for a predetermined time to prevent such cut, wrinkles, extension, etc. of the transfer paper sheet 10 while the transfer paper sheet 10 is conveyed within the toner removing apparatus. In this case, an operation of the toner removing apparatus may be controlled such that the conveying speeds are switched for the predetermined time and the transfer paper sheet 10 is flexed by a predetermined flexing amount.

A method for controlling a conveying operation of the transfer paper sheet will next be explained with reference to FIGS. 15*a* and 15*b*.

Figure 15A:
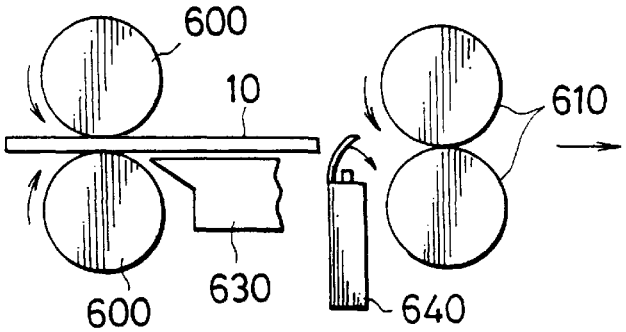
FIG. 15*a* is a view for explaining a method for conveying a transfer paper sheet in the toner removing apparatus shown in FIG. 14.

In FIG. 15*a*, a first conveying roller pair 600 and a second conveying roller pair 610 as the above supporting-conveying means are arranged such that the second conveying roller pair 610 is located on a downstream side in a conveying direction of the transfer paper sheet 10. A paper guide plate 630 is arranged between the first and second conveying roller pairs. For example, a paper detecting sensor 640 is arranged just before the second conveying roller pair 610 to know an inserting period in which a front end of the transfer paper sheet 10 is inserted into a nipping portion of the second conveying roller pair 610.

Figure 15B:
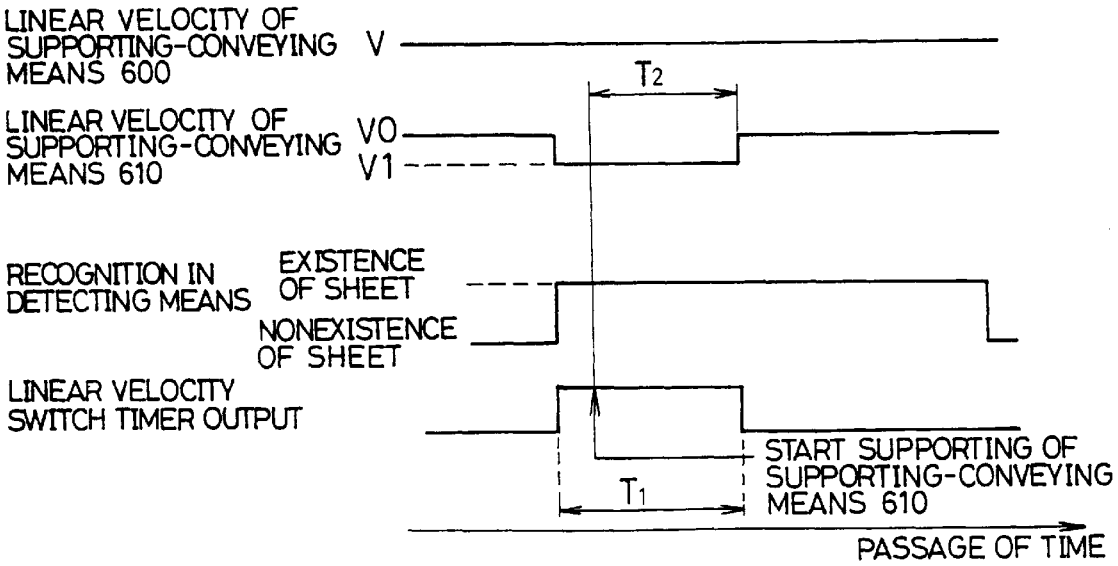
FIG. 15*b* is a timing chart with respect to this conveying method.

Operations of the first and second conveying roller pairs 600 and 610 are controlled by using a detecting signal of this paper detecting sensor 640 as shown by a timing chart of FIG. 15*b*. Namely, the first and second conveying roller pairs 600 and 610 are operated such that each of conveying speeds of the first and second conveying roller pairs is equal to a normal conveying speed V0 until the front end of the transfer paper sheet 10 reaches the nipping portion of the second conveying roller pair 610. When the front end of the transfer paper sheet is detected by the paper detecting sensor 640, the conveying speed of the second conveying roller pair 610 is switched to a low speed V1 lower than the normal conveying speed V0. A set time T1 corresponds to a time required to pass a certain front end portion of the transfer paper sheet through the nipping portion of the second conveying roller pair 610 from a time point of this detection of the front end of the transfer paper sheet. The conveying speed of the second conveying roller pair 610 is returned to the normal conveying speed with this set time T1 as a passing time point. In accordance with such a construction, a portion of the transfer paper sheet between the first and second conveying roller pairs 600 and 610 is flexed for a period T2 in which a rear end portion of the transfer paper sheet is conveyed at the normal speed V0 by the first conveying roller pair 600 and a front end portion of the transfer paper sheet is conveyed at the low speed V1 by the second conveying roller pair 610. Accordingly, no transfer paper sheet is stressed so that it is possible to prevent the transfer paper sheet from being extended, cut and wrinkled in the conveying direction. Further, a maximum slackening amount of the transfer paper sheet is determined by the above time T2 and a speed difference (V0−V1). Accordingly, it is also possible to prevent wrinkles of the transfer paper sheet in folding and overlapping by setting the time T2 and the speed difference (V0−V1) such that the maximum slackening amount is provided to such an extent that no transfer paper sheet is folded and overlapped.

It is sufficient to provide timing of the speed switch of the second conveying roller pair 610 by using only the detecting signal of the paper detecting sensor 640, or additionally using another timing information such as a paper feed starting signal of the toner removing apparatus. Accordingly, the paper detecting sensor 640 may be arranged in another place if this speed switch timing can be provided in this place. For example, the paper detecting sensor 640 may be arranged on a downstream side from the second conveying roller pair 610. In this case, the toner removing apparatus may be constructed such that the conveying speed of the second conveying roller pair 610 is switched to the low speed V0 by using another timing information and is returned to the normal conveying speed by using the detecting signal of the paper detecting sensor 640. Otherwise, the toner removing apparatus may be constructed such that the above conveying speed is switched to the low speed V0 by using the detecting signal of the paper detecting sensor 640 after a front end portion of the transfer paper sheet passes through the nipping portion of the second conveying roller pair 610 to a certain extent. In the example of FIG. 15*a*, the paper detecting sensor 640 is of a contact type, but may be of a noncontact type using light, etc.

Further, a dedicated drive motor may be used to rotate each of the conveying roller pairs 600 and 610 such that the conveying speeds of these conveying roller pairs are different from each other for a predetermined period.

The above-mentioned problems of the transfer paper sheet can be solved by applying the above conveying method to the toner removing apparatus shown in FIG. 14. Namely, the conveying speeds of the conveying roller pairs 600 and 610 are controlled in one combination set such that the feed roller 103*a* and the separating roller 103*b* of the paper feed unit 100 correspond to the first conveying roller pair 600, and the upper heating roller 315 and the offset belt 311 of the toner separating unit 300 correspond to the second conveying roller pair 610. The conveying speeds of the conveying roller pairs 600 and 610 may be controlled in another combination set such that the upper heating roller 315 and the offset belt 311 of the toner separating unit 300 correspond to the first conveying roller pair 600, and the heating drum 411 and the paper pressing belt 412 of the drying unit 400 correspond to the second conveying roller pair 610. Further, each of these two combinations may be sequentially set in accordance with a movement of the transfer paper sheet 10 such that the above-mentioned problems of the transfer paper sheet are not caused in any conveying region from the paper feed unit 100 to the drying unit 400.

In the above conveying method, the conveying speed of the supporting-conveying means on the downstream side is switched to a low speed so that a conveying speed difference causing flexure of the transfer paper sheet is set between the conveying speeds of the supporting-conveying means on the downstream and upstream sides. Conversely, the conveying speed of the supporting-conveying means on the upstream side may be switched to a high speed.

As mentioned above, in accordance with a first or second construction of the present invention, heating of an image forming substance is maintained until an image holding member is separated from a separating member. The image holding member is separated from the separating member before the image forming substance is cooled and solidified. Accordingly, at a separating time, the image forming substance is maintained in a softened or melted state so that adhesive force of the image forming substance with respect to a surface of the separating member can be greatly reduced in comparison with adhesive force of the image forming substance with respect to the image holding member. Accordingly, it is possible to greatly improve separating performance of the image forming substance by the separating member.

In accordance with a third construction of the present invention, a curvature separating portion is formed on the downstream side of a heating-supporting member in a moving direction of the separating member in a position in which no image forming substance is cooled and solidified. Accordingly, when the image holding member is separated from the separating member, the image forming substance is maintained in a softened or melted state so that adhesive force of the image forming substance with respect to a surface of the separating member can be greatly reduced in comparison with adhesive force of the image forming substance with respect to the image holding member. Accordingly, it is possible to greatly improve separating performance of the image forming substance by the separating member.

In accordance with a fourth construction of the present invention, a planar portion is formed on a surface of the heating-supporting member coming in press contact with an elastic member roller used as the press contact member. Accordingly, a press contact portion of the elastic member roller can be formed on the same plane as a conveying path of the image holding member. Therefore, it is possible to reduce generation of a jam and wrinkles of the image holding member within the conveying path.

Further, a length of the planar portion in the moving direction of the separating member is set to be equal to a length of the press contact portion between the elastic member roller and the heating-supporting member in this moving direction. Accordingly, the curvature separating portion can be formed in an end portion of the press contact portion. Therefore, the image holding member can be separated from the separating member surface in the region of a higher temperature. Thus, adhesive force of the image forming substance with respect to the separating member surface can be further greatly reduced in comparison with adhesive force of the image forming substance with respect to the image holding member. Accordingly, it is possible to further greatly improve separating performance of the image forming substance by the separating member.

A tapered portion is formed on the surface of the heating-supporting member such that the tapered portion is lowered from an end portion of the press contact portion on an upstream side in the moving direction of the separating member toward this upstream side. The separating member is slid and moved in the planar portion and the tapered portion on the surface of the heating-supporting member. Therefore, when a liquid is provided to the image holding member, the liquid tending to be collected in an inlet port of the press contact portion can be sequentially discharged along a surface of the tapered portion. Accordingly, a reduction in thermal efficiency of the separating member caused by the liquid collection can be prevented when the separating member is heated.

In accordance with a fifth construction of the present invention, the heating-supporting member is constructed by a high thermal conductor having a high thermal conductive property so that a time for heating the heating-supporting member to a predetermined temperature is shortened. Accordingly, a warm-up time of the heating-supporting member is shortened and responsibility to a temperature adjustment of the heating-supporting member is improved. Therefore, the temperature of the surface of the heating-supporting member can be stabilized.

When a holder for holding the heating-supporting member through an insulator is further arranged, a heat loss caused by transmission of heat from the heating-supporting member can be reduced. Accordingly, thermal efficiency of the heating-supporting member can be improved.

In accordance with a sixth construction of the present invention, the removing apparatus further has a temperature detecting means for detecting a temperature of the separating member surface just after the image holding member is separated from the separating member. Accordingly, a change in temperature of the separating member can be detected directly and instantly in the vicinity of a curvature separating position of the image holding member. Therefore, results of this temperature detection can be used in temperature control of the separating member by the heating-supporting member in the vicinity of the curvature separating position so that the temperature of the separating member can be stabilized.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for removing an image forming substance from an image holding material in which the image forming substance on the image holding material is heated to be melted or softened, comprising:

a separating means, having an adhesive force with respect to said image forming substance which is stronger than an adhesive force between said image holding material and said image forming substance, for removing said image forming substance from said image holding member by contacting said separating means with said image holding material to attach said image forming substance from said image holding material to said separating means and separating said separating means from said image holding material in order to remove said image forming substance from said image holding material;

a heating means for maintaining a heating state during a period until said separating means comes in contact with said image forming substance on said image holding material and said image forming substance is transferred to said separating means; and a cleaning means for removing said image forming substance which has been transferred to said separating means and solidified thereon.

2. An apparatus for removing an image forming substance on an image holding material, comprising:

a belt wrapped around rollers, the belt having an adhesive force with respect to said image forming substance which is stronger than an adhesive force between said image holding material and said image forming substance;

a heater which melts or softens said image forming substance on said image holding material so that said image forming substance can be transferred from the image holding material to the belt when the image forming substance on the image holding material and the belt contact each other; and a brush roller, contacting the belt, which brushes and thereby removes said image forming substance from said belt after said image forming substance has solidified on the belt.

3. An apparatus as claimed in claim 2, wherein:

the length from a separating position at which said image holding material and said belt are separated from each other to a cleaning position at which said brush roller removes said image forming substance transferred from said image holding material located on said belt, has a distance such that said melted or softened image forming substance transferred to said belt at said separating position can change from the melted or softened state to a solidified state when said image forming substance on said belt reaches said cleaning position.

4. An apparatus as claimed in claim 2, further comprising:

a fan which blows air on said melted or softened image forming substance transferred to said belt from said image holding material in order to change the image forming substance on the belt from the melted or softened state to the solidified state, said fan provided between a separating position at which said image holding material and said belt are separated from each other and a cleaning position at which said brush roller removes said image forming substance transferred from said image holding material located on said belt from said belt.

5. An apparatus as claimed in claim 2 wherein:

said belt comprises a material having at least a resin.

6. An apparatus as claimed in claim 5, wherein:

said belt has at least a surface layer that transfers said image forming substance located on said image holding material, and:

said surface layer has adhesive force with respect to said image forming substance which is stronger than the adhesive force between said image forming substance and said image holding material.

7. An apparatus as claimed in claim 5, further comprising:

a roller that comes in contact with a rear surface of said belt opposed to a surface thereof to which said image forming substance is transferred from said image holding material, said roller forming a specified curvature in said separating member that is the belt, wherein:

while the melting or softening state of said image forming substance is maintained, said image holding material and said belt are separated from each other at a position of the curvature formed by said roller.

8. An apparatus as claimed in claim 2, further comprising:

a temperature sensor for sensing a temperature of said belt; and a controller for controlling the heating of said heater on said temperature sensor.

9. An apparatus as claimed in claim 2, further comprising:

a liquid supply container which supplies said image holding material with an unstabilizing substance that reduces the adhesive force between said image holding material and said image forming substance before said image forming substance is transferred from said image holding material to said belt.

10. An apparatus as claimed in claim 9, further comprising:

a heated drum provided downstream in a drive direction from said belt relative to said separating position at which said image holding material and said belt are separated from each other in order to dry said image holding material.

11. An apparatus for removing an image forming substance on an image holding material, comprising:

a belt wrapped around rollers, the belt having an adhesive force with respect to said image forming substance which is stronger than an adhesive force between said image holding material and said image forming substance;

a heater which melts or softens said image forming substance on said image holding material;

a motor which drives said separating member; and a support surface that contacts a rear surface of said belt opposed to a surface thereof to which said image forming substance is transferred, said support surface having a curved separating portion with a specified curvature at a downstream portion of the support surface, relative to a direction in which said belt is driven by said motor, at a position at which a melting or softening state of said image forming substance provided by said heater is maintained and where the belt and the image holding material are separated from each other.

12. An apparatus as claimed in claim 11, wherein:

said support surface has said heater built therein.

13. An apparatus as claimed in claim 11, wherein:

said support surface is a fixing block contacting a rear surface of said belt opposed to a surface thereof to which said image forming substance is transferred, and when said belt is driven by said motor, a rear surface of said belt slides on a surface of said fixing block.

14. An apparatus as claimed in claim 13, wherein:

at least the surface of said support surface having a predetermined coefficient of friction.

15. An apparatus as claimed in claim 11, further comprising:

a roller, opposed to said support surface via said belt, to pressurize said belt so that at least said image forming substance comes in contact with said belt.

16. An apparatus as claimed in claim 15, wherein:

said roller is a pressurizing roller in which at least a surface thereof that comes in contact with said separating member is elastic.

17. An apparatus for removing an image forming substance from an image holding material in which the image forming substance on the image holding material is heated to be melted or softened, comprising:

a supply means for supplying said image holding material with an unstabilizing substance that reduces an adhesive force between said image holding material and said image forming substance;

a separating means having an adhesive force with respect to said image forming substance which is stronger than an adhesive force between said image holding material and said image forming substance, for removing said image forming substance from said image holding member by contacting said separating means with said image holding material to attach said image forming substance from said image holding material on said separating means and coming in contact with said image forming substance and separating said separating member from said image holding material in order to remove said image forming substance from said image holding material; and a heating means for maintaining heating until said image holding material and said separating means are separated from each other.

18. An apparatus for removing an image forming substance on an image holding material, comprising:

a liquid supply container which supplies said image holding material with an unstabilizing substance that reduces an adhesive force between said image holding material and said image forming substance;

a belt wrapped around rollers, the belt having an adhesive force with respect to said image forming substance which is stronger than an adhesive force between said image holding material and said image forming substance;

a heater which melts or softens said image forming substance on said image holding material so that said image forming substance can be transferred from the image holding material to the belt when the image forming substance on the image holding material and the belt contact each other.

19. An apparatus as claimed in claim 18, further comprising:

a brush roller, contacting the belt, which brushes and thereby removes said image forming substance which has been transferred to said belt from said image holding material when said image forming substance is solidified; and a fan which blows air on said image forming substance which has been transferred to said belt from said image holding material from a melted or softened state to a solidified state, said fan located between a separating position at which said image holding material and said belt are separated from each other and a cleaning position at which said brush roller removes from said belt said image forming substance transferred from said image holding material.

20. An apparatus as claimed in claim 18, wherein:

said belt comprises an endless belt having at least a surface which comes in contact with said image forming substance on said image holding material with an adhesive force with respect to said image forming substance which is stronger than the adhesive force between said image holding material and said image forming substance.

21. An apparatus as claimed in claim 20, wherein:

the at least a surface of said endless belt which comes in contact with said image forming substance on said image holding material is formed of a material having at least a resin.

22. An apparatus as claimed in claim 20, further comprising:

a roller which contacts a rear surface of said endless belt opposed to a surface thereof to which said image forming substance is transferred from said image holding material, said roller forming a specified curvature in said endless belt, wherein:

while the melting or softening state of said image forming substance is maintained, said image holding material and said endless belt are separated from each other at a position of the curvature formed by said roller.

23. An apparatus as claimed in claim 18, further comprising:

a support surface that contacts a rear surface of said belt opposed to a surface thereof to which said image forming substance is transferred.

24. An apparatus as claimed in claim 23, wherein:

said support surface is a fixing block with said belt sliding on a surface thereof when said belt is driven by a motor.

25. An apparatus as claimed in claim 24, wherein:

at least the surface of said fixing block which comes in contact with said belt is subjected to low friction.

26. An apparatus as claimed in claim 18, further including:

a temperature sensor for sensing a temperature of said belt; and a controller for controlling the heating of said heater using said temperature sensor.

27. An apparatus for separating an image forming substance on an image holding material from said image holding material, comprising:

a separating belt formed so as to have no ends and including at least a surface having an adhesive force with respect to said image forming substance which is stronger than an adhesive force between said image holding material and said image forming substance;

a plurality of drive rollers around which said separating belt is passed and which drive said separating belt;

a block that supports said separating belt at least from a rear surface of said separating belt opposed to a surface thereof with which said image forming substance comes in contact; and a heater for melting or softening said image forming substance on said image holding material, wherein:

a region where an end of said block which is disposed downstream in the drive direction of said separating belt is a separating position at which said separating belt and said image holding material are separated from each other; and said image holding material with said image forming substance which has been melted or softened by said heater contacts with said separating belt, and separates from said separating belt at said separating position while the melting or softening state of said image forming substance is maintained in order to separate said image forming substance from said image holding material.

28. An apparatus as claimed in claim 27, further including:

a liquid supply container which supplies said image holding material with an unstabilizing liquid which unstabilizes the adhesive force between said image holding material and said image forming substance before said separating belt comes in contact with said image forming substance.

29. An apparatus as claimed in claim 28, further including:

a heated drum for drying said unstabilizing liquid which is in said image holding material supplied from said liquid supply containers.

30. An apparatus as claimed in claim 27, further including:

a pressurizing roller opposed to said block via said separating belt and being in pressurized contact with said separating belt.

31. An apparatus as claimed in claim 27, wherein:

said separating belt includes an adhesion layer that comes in contact with at least said image forming substance on said image holding material, and said adhesion layer has an adhesive force with respect to said image forming substance which is stronger than the adhesive force between said image forming substance and said image holding material.

32. An apparatus as claimed in claim 31, wherein:

the adhesion layer of said separating belt is formed of a material having at least a resin.

33. An apparatus as claimed in claim 31, wherein:

at least the surface of said block contacting said separating belt is processed so as to be subjected to low friction.

34. An apparatus as claimed in claim 33, wherein:

said low friction processing coats a low friction layer on at least the surface of said block which contacts said separating belt.

35. An apparatus as claimed in claim 27, wherein:

at least the surface of said block contacting said separating belt is processed so as to be subjected to low friction.

36. An apparatus as claimed in claim 35, wherein:

said low friction processing coats a low friction layer on at least the surface of said block which contacts said separating belt.

37. An apparatus as claimed in claim 27, further including:

a cooling fan for solidifying said melted or softened image forming substance on said separating belt after said separating belt and said image holding material have been separated from each other.

38. An apparatus as claimed in claim 37, further including:

a brush roller for removing said solidified image forming substance from said separating belt.

39. An apparatus as claimed in claim 27, further including:

a supply member configured to supply said image holding material with an unstabilizing liquid which unstabilizes the adhesive force between said image holding material and said image forming substance before said separating belt comes in contact with said image forming substance.

40. An apparatus as claimed in claim 39, further including:

a drying member configured to dry said unstabilizing liquid supplied from said supply unit, said unstabilizing liquid being contained in said image holding material separated from said separating belt at said separating position.

41. An apparatus as claimed in claim 39, further including:

a pressurizing roller opposed to said block via said separating belt and being in pressurized contact with said separating belt.

42. An apparatus as claimed in claim 27, further including:

a cooling member configured to solidify said melted or softened image forming substance on said separating belt after said separating belt and said image holding material have been separated from each other.

43. An apparatus as claimed in claim 42, further including:

a cleaning member configured to remove said solidified image forming substance from said separating belt.

44. An apparatus as claimed in claim 43, wherein:

said cleaning member is a brush roller or a blade.

45. An apparatus for removing an image forming substance from an image holding material, comprising:

a liquid supply means for supplying a liquid to said image holding material on which said image forming substance is stably attached;

an image forming substance separating means for driving a separating member having a stronger adhesive force than said image holding material with respect to said image forming substance on said image holding material to which said liquid has been supplied such that a surface of said separating member comes in contact with said image forming substance on said image holding material and then separates said image forming substance from said image holding material, while gripping said image holding material between the surface of said separating member and a backup member;

a drying means for drying said image holding material from which said image forming substance has been separated by said image forming substance separating means while gripping and transferring said image holding material; and a transfer means for transferring said image holding material while supporting said image holding material;

wherein an interval between a position at which said separating member and said backup member are opposed to each other and a position in said drying means at which the gripping of said image holding material is started is set longer than a length of said image holding material in a transfer direction thereof and wherein the transfer means is disposed within said interval.

46. An apparatus for removing an image forming substance from an image holding material, comprising:

a liquid supply container which supplies a liquid to said image holding material on which said image forming substance is stably deposited;

a belt having a stronger adhesive force than said image holding material with respect to said image forming substance on said image holding material to which said liquid has been supplied such that said image holding material comes in contact between said belt and backup surface and then separates from said belt, thereby transferring said image forming substance from said image holding material to said belt;

a heated drum which dries said image holding material from which said image forming substance has been separated by said belt;

rollers which transfer said image holding material, while supporting said image holding material;

wherein an interval between a position at which said belt and said backup surface are opposed to each other and a position in said drying member at which the gripping of said image holding material is started is set longer than a length of said image holding material in a transfer direction thereof and wherein the rollers which transfer said image holding material are disposed within said interval.

47. An apparatus for removing an image forming substance from an image holding material, said apparatus using a liquid supply means to execute at least a liquid supply processing for said image holding material in order to remove said image forming substance from said image holding material on a surface of which said image forming substance has been attached, characterized in that the apparatus includes:

a control means for driving and controlling;

a first gripping and transferring means for transferring said image holding material within the apparatus; and a second gripping and transferring means for transferring said image holding material to which said liquid has been supplied by said liquid supply means on a downstream side of the transfer direction relative to said first gripping and transferring means such that sagging occurs in said image holding material between said first and second gripping and transferring means.

48. An image holding material processing apparatus for executing at least a liquid supply processing for an image holding material using a liquid supply member, characterized in that the apparatus comprises:

a control means for driving and controlling;

a first gripping and transferring means for transferring said image holding material within the apparatus; and a second gripping and transferring means for transferring said image holding material to which said liquid has been supplied by said liquid supply means on a downstream side of the transfer direction relative to said first gripping and transferring means such that sagging occurs in said image holding material between said first and second gripping and transferring means.

49. An image holding material processing apparatus for executing at least a liquid supply processing for an image holding material using a liquid supply member, characterized in that the apparatus comprises:

a control member for driving and controlling;

a first pair of rollers for transferring said image holding material within the apparatus; and a second pair of rollers for transferring said image holding material to which said liquid has been supplied by said liquid supply member on a downstream side of the transfer direction relative to said first pair of rollers such that sagging occurs in said image holding material between said first and second pairs of rollers.

50. An apparatus for removing an image forming substance from an image holding material, said apparatus using a liquid supply container which supplies liquid to said image forming substance in order to remove said image forming substance from said image holding material on a surface of which said image forming substance has been attached, characterized in that the apparatus includes:

a control member for driving and controlling;

a first pair of rollers for transferring said image holding material within the apparatus; and a second pair of rollers for transferring said image holding material to which said liquid has been supplied by said liquid supply member on a downstream side of the transfer direction relative to said first pair of rollers, such that sagging occurs in said image holding material between said first and second pairs of rollers.

51. An apparatus as claimed in claim 50 which is configured such that during a specified period of a duration in which said image holding material is being gripped and transferred by both said first and second gripping and transferring members, a transfer speed of said second gripping and transferring member is set higher than a transfer speed of said first pair of rollers by said control member.

52. An apparatus as claimed in claim 50, further comprising:

a paper detection sensor which detects an amount of sagging in said image holding material between said first and second pairs of rollers, wherein based on an output of said paper detection sensor, said control member switches a condition for driving so as to prevent at least increases in the amount of sagging of said image holding material between said first and second pairs of rollers once said amount of sagging has reached a specified value.

53. An apparatus for separating an image forming substance on an image holding material from said image holding material, comprising:

a separating belt including at least a surface having adhesive force with respect to said image forming substance which is stronger than an adhesive force between said image holding material and said image forming substance;

a supply roller around which said separating belt is wrapped;

a takeup roller for taking up said separating belt via a position at which said separating belt comes in contact with said image holding material and a position at which said separating belt is separated from said image holding material;

a heater for melting or softening said image forming substance on said image holding material; and a motor for driving said separating belt such that said belt from said supply roller is wrapped around said takeup roller, wherein:

the apparatus attaches said image forming substance from said image holding material, which has been melted or softened by said heater, on said separating belt, and separates said separating belt from said image holding material while a melting or softening state of said image forming substance is maintained in order to separate said image forming substance from said image holding material.

54. An apparatus for separating an image forming substance on an image holding material from said image holding material, comprising:

a belt which removes said image forming substance from said image holding material;

rollers which transfer said image holding material, from which said image forming substance has been removed by said belt; and a tray in which said image holding material transferred by said rollers are stacked in such a way that a surface of said image holding material, from which said image forming substance has been removed by said belt, faces upward.

55. An apparatus for removing an image forming substance on an image holding material, comprising:

a belt wrapped around rollers, the belt having an adhesive force with respect to said image forming substance which is stronger than an adhesive force between said image holding material and said image forming substance;

a heater which melts or softens said image forming substance on said image holding material so that said image forming substance can be transferred from the image holding material to the belt when the image forming substance on the image holding material and the belt contact each other; and a blade contacting the belt, which scrapes and thereby removes said image forming substance from said belt after said image forming substance has solidified on the belt.

56. An apparatus for removing an image forming substance on an image holding material, comprising:

a separating member, having an adhesive force with respect to said image forming substance which is stronger than an adhesive force between said image holding material and said image forming substance, configured to remove said image forming substance from said image holding member by contacting said separating member with said image holding material to transfer said image forming substance to said separating member from said image holding material and separating said separating member from said image holding material in order to remove said image forming substance from said image holding material; and a heating member configured to heat so that said image forming substance on said image holding material is melted or softened, wherein:

the apparatus attaches said image forming substance, which has been melted or softened by said heating member, on said separating member from said image holding material while a melting or softening state of said image forming substance is maintained in order to separate said image holding material from said separating member, thereby removing said image forming substance from said image holding material, the apparatus further including:

a cleaning member configured to remove said image forming substance, which has been transferred onto said separating member from said image holding material, from said separating member while said image forming substance is solidified.

57. An apparatus as claimed in claim 56, wherein:

the length from a separating position at which said image holding material and said separating member are separated from each other to a cleaning position at which said cleaning member removes said image forming substance transferred from said image holding material located on said separating member, has a distance such that said melted or softened image forming substance transferred to said separating member at said separating position can change from the melted or softened state to a solidified state at said cleaning position.

58. An apparatus as claimed in claim 56, further comprising:

a cooling member configured to change said melted or softened image forming substance transferred to said separating member from said image holding material, from the melted or softened state to the solidified state, said cooling member provided between a separating position at which said image holding material and said separating member are separated from each other and a cleaning position at which said cleaning member removes said image forming substance transferred from said image holding material located on said separating member from said separating member.

59. An apparatus as claimed in claim 56, wherein:

said separating member is a belt and is formed of a material having at least a resin.

60. An apparatus as claimed in claim 59, wherein:

said belt has at least a surface layer that transfers said image forming substance located on said image holding material, and said surface layer has an adhesive force with respect to said image forming substance which is stronger than the adhesive force between said image forming substance and said image holding material.

61. An apparatus as claimed in claim 59, further comprising:

a roller that comes in contact with a rear surface of said separating member opposed to a surface thereof to which said image forming substance is transferred from said image holding material, said roller forming a specified curvature in said separating member that is the belt, wherein:

while the melting or softening state of said image forming substance is maintained, said image holding material and said separating member are separated from each other at a position of the curvature formed by said roller.

62. An apparatus as claimed in claim 36, further comprising:

a temperature sensor configured to sense a temperature of said separating member; and a controller configured to control the heating of said heating member using said temperature sensed by said temperature sensor.

63. An apparatus as claimed in claim 56, further comprising:

a supply member configured to supply said image holding material with an unstabilizing substance that reduces the adhesive force between said image holding material and said image forming substance, said supply member supplying said unstabilizing substance before said image forming substance is transferred from said image holding material to said separating member.

64. An apparatus as claimed in claim 63, wherein:

said supply member is configured to supply said unstabilizing substance which is an unstabilizing liquid.

65. An apparatus as claimed in claim 64, further comprising:

a drying member provided downstream in a drive direction from said separating member relative to said separating position at which said image holding material and said separating member are separated from each other configured to dry said image holding material.

66. An apparatus for removing an image forming substance on an image holding material, comprising:

a separating member having an adhesive force with respect to said image forming substance which is stronger than an adhesive force between said image holding material and said image forming substance, configured to remove said image forming substance from said image holding member by contacting said separating member with said image holding material to transfer said image forming substance to said separating member from said image holding material and separate said separating member from said image holding material in order to remove said image forming substance from said image holding material;

a heating member configured to heat so that said image forming substance on said image holding material is melted or softened;

a drive member configured to drive said separating member; and a supporting member that contacts with a rear surface of said separating member opposed to a surface thereof to which said image forming substance is transferred, said supporting member having a curved separating portion with a specified curvature at a downstream portion of said supporting member, relative to a direction in which said separating member is driven by said drive member, at a position at which a melting or softening state of said image forming substance provided by said heating member is maintained, and wherein:

said separating member is guided along said curved separating portion, in which said separating member and said image holding material are separated from each other.

67. An apparatus as claimed in claim 66, wherein:

said supporting member has said heating member built therein.

68. An apparatus as claimed in claim 67, wherein:

said heating member is a heater.

69. An apparatus as claimed in claim 66, wherein:

said supporting member is a fixing block contacting a rear surface of said separating member opposed to a surface thereof to which said image forming substance is transferred, and when said separating member is driven by said drive member, a rear surface of said separating member slides on a surface of said fixing block.

70. An apparatus as claimed in claim 69, wherein:

at least the surface of said supporting member having a predetermined coefficient of friction.

71. An apparatus as claimed in claim 66, further comprising:

a pressurizing member, opposed to said supporting member via said separating member, configured to pressurize said separating member so that at least said image forming substance comes in contact with said separating member.

72. An apparatus as claimed in claim 71, wherein:

said pressurizing member is a pressurizing roller in which at least a surface thereof that comes in contact with said separating member is elastic.

73. An apparatus for removing an image forming substance on an image holding material, comprising:

a supply member configured to supply image holding material with an unstabilizing substance that reduces an adhesive force between said image holding material and said image forming substance;

a separating member having an adhesive force with respect to said image forming substance which is stronger than an adhesive force between said image holding material and said image forming substance, said separating member configured to remove said image forming substance from said image holding member by contacting said separating means with said image holding material to transfer said image forming substance to said separating member from said image holding material and separating said separating member from said image holding material in order to remove said image forming substance from said image holding material; and a heating member configured to heat said image forming substance on said image holding material so that said image forming substance is melted or softened.

74. An apparatus as claimed in claim 73, further comprising:

a cleaning member configured to remove said image forming substance which has been transferred to said separating member from said image holding material from said separating member when said image forming substance is solidified; and a cooling member configured to change said image forming substance which has been transferred to said separating member from said image holding material from a melted or softened state to a solidified state, said cooling member located between a separating position at which said image holding material and said separating member are separated from each other and a cleaning position at which said cleaning member removes said image forming substance transferred from said image holding material located on said separating member from said separating member.

75. An apparatus as claimed in claim 73, wherein:

said separating member comprises an endless belt having at least a surface which comes in contact with said image forming substance on said image holding material with an adhesive force with respect to said image forming substance which is stronger than the adhesive force between said image holding material and said image forming substance.

76. An apparatus as claimed in claim 75, wherein:

the at least a surface of said separating member which comes in contact with said image forming substance on said image holding material is formed of a material having at least a resin.

77. An apparatus as claimed in claim 75, further comprising:

a roller which contacts a rear surface of said separating member opposed to a surface thereof to which said image forming substance is transferred from said image holding material, said roller forming a specified curvature in said endless belt, wherein:

while the melting or softening state of said image forming substance is maintained, said image holding material and said separating member are separated from each other at a position of the curvature formed by said roller.

78. An apparatus as claimed in claim 73, further comprising:

a supporting member that contacts a rear surface of said separating member opposed to a surface thereof to which said image forming substance is transferred.

79. An apparatus as claimed in claim 78, wherein:

said supporting member is a fixing block with said separating member sliding on a surface thereof when said separating member is driven by a drive member.

80. An apparatus as claimed in claim 79, wherein:

at least the surface of said supporting member which comes in contact with said separating member is subjected to low friction.

81. An apparatus as claimed in claim 73, further including:

a temperature sensor configured to sense a temperature of said separating member; and a controller configured to control the heating of said heating member using said temperature sensor.

82. An apparatus for removing an image forming substance from an image holding material, comprising:

a liquid supply member configured to supply a liquid to said image holding material on which said image forming substance is stably deposited;

an image forming substance separating member configured to drive a separating device having a stronger adhesive force than said image holding material with respect to said image forming substance on said image holding material to which said liquid has been supplied such that a surface of said separating device comes in contact with said image forming substance on said image holding material and then separates said image forming substance from said image holding material, while gripping said image holding material between the surface of said separating device and a backup member;

a drying member configured to dry said image holding material from which said image forming substance has been separated by said image forming substance separating member while gripping and transferring said image holding material;

a transfer member configured to transfer said image holding material, while supporting said image holding material;

wherein an interval between a position at which said separating device and said backup member are opposed to each other and a position in said drying member at which the gripping of said image holding material is started is set longer than a length of said image holding material in a transfer direction thereof and wherein the transfer member is disposed within said interval.

83. An image holding material processing apparatus for executing at least a liquid supply processing for an image holding material using a liquid supply member, characterized in that the apparatus comprises:

a control member configured to drive and control;

a first gripping and transferring member configured to transfer said image holding material within the apparatus; and a second gripping and transferring member configured to transfer said image holding material to which said liquid has been supplied by said liquid supply member on a downstream side of the transfer direction relative to said first gripping and transferring member such that sagging occurs in said image holding material between said first and second gripping and transferring members.

84. An apparatus for removing an image forming substance from an image holding material, said apparatus using a liquid supply member to execute at least a liquid supply processing for said image forming substance in order to remove said image forming substance from said image holding material on a surface of which said image forming substance has been attached, characterized in that the apparatus includes:

a control member configured to drive and control;

a first gripping and transferring member configured to transfer said image holding material within the apparatus; and a second gripping and transferring member configured to transfer said image holding material to which said liquid has been supplied by said liquid supply member on a downstream side of the transfer direction relative to said first gripping and transferring member, such that sagging occurs in said image holding material between said first and second gripping and transferring members.

85. An apparatus as claimed in claim 84 which is configured such that during a specified period of a duration in which said image holding material is being gripped and transferred by both said first and second gripping and transferring members, a transfer speed of said second gripping and transferring member is set higher than a transfer speed of said first gripping and transferring member.

86. An apparatus as claimed in claim 84, further comprising:

a sagging amount detection member configured to detect an amount of sagging in said image holding material between said first and second gripping and transferring members, wherein based on an output of said sagging amount detection means, said control member switches a condition for driving so as to prevent at least increases in the amount of sagging of said image holding material between said first and second gripping and transferring members once said amount of sagging has reached a specified value.

87. An apparatus for separating an image forming substance on an image holding material from said image holding material, comprising:

a removing member configured to remove said image forming substance from said image holding material;

a transfer member configured to transfer said image holding material, from which said image forming substance has been removed by said removing member; and a stacker in which said image holding materials transferred by said transfer member are stacked in such a way that a surface of said image holding material, from which said image forming substance has been removed by said removing member, faces upward.

* * * * *